US010974503B2

(12) United States Patent
Kurihara

(10) Patent No.: US 10,974,503 B2
(45) Date of Patent: Apr. 13, 2021

(54) RECORDING APPARATUS AND CORRECTION METHOD

(71) Applicant: Oki Data Corporation, Tokyo (JP)

(72) Inventor: Kazuteru Kurihara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/746,078

(22) Filed: Jan. 17, 2020

(65) Prior Publication Data

US 2020/0269572 A1 Aug. 27, 2020

(30) Foreign Application Priority Data

Feb. 25, 2019 (JP) ..... JP2019-031772

(51) Int. Cl.

*B41J 29/393* (2006.01)
*B41J 19/14* (2006.01)
*B41J 2/045* (2006.01)
*B41J 2/21* (2006.01)

(52) U.S. Cl.

CPC ..... *B41J 2/04558* (2013.01); *B41J 2/0458* (2013.01); *B41J 19/145* (2013.01); *B41J 29/393* (2013.01); *B41J 2/2135* (2013.01)

(58) Field of Classification Search

CPC .... B41J 2/04558; B41J 2/0458; B41J 29/393; B41J 19/145; B41J 2/2135

See application file for complete search history.

(56) References Cited

U.S. PATENT DOCUMENTS

2005/0147424 A1* 7/2005 Kato ..... G03G 15/5058 399/49
2012/0007917 A1* 1/2012 Uchida ..... B41J 11/425 347/37
2012/0229546 A1* 9/2012 Okada ..... B41J 2/2142 347/14

FOREIGN PATENT DOCUMENTS

JP 2014-111326 A 6/2014
JP 2016-182679 A 10/2016

* cited by examiner

*Primary Examiner* — Yaovi M Ameh
(74) *Attorney, Agent, or Firm* — Muncy, Geissler, Olds & Lowe, P.C.

(57) ABSTRACT

A recording apparatus includes a recording head, a carrying part, a carriage and a detector that optically detects an image recorded on a recording medium, and a controller that obtains a correction value of recording positions of dots from a test pattern, and corrects the recording positions of the dots based on the correction value. The test pattern includes an adjustment pattern and a reference pattern, the adjustment pattern includes multiple overlapping patterns that are each formed by overlapping two basic patterns, the reference pattern is formed of predetermined patterns that each correspond to the multiple overlapping patterns, the correction value of recording positions of dots, which is obtained by the controller, is calculated based on adjustment detection results respectively obtained by detecting the multiple overlapping patterns and a reference detection result obtained by detecting the predetermined pattern forming the reference pattern, and the controller corrects the recording positions of dots based on the correction value.

10 Claims, 16 Drawing Sheets

RECORDING APPARATUS AND CORRECTION METHOD

TECHNICAL FIELD

The present invention relates to a recording apparatus and a correction method, for example, relates to a recording apparatus having an inkjet type recording head that discharges ink onto a recording medium.

BACKGROUND

Conventionally, as a recording apparatus of this kind, there is a serial inkjet printer. A serial inkjet printer prints an image on a recording medium while moving an inkjet type recording head back and forth in a main scanning direction perpendicular to a carrying direction (sub-scanning direction) of the recording medium.

In such a serial inkjet printer, for example, an adjustment pattern is printed on a recording medium, and light is irradiated to the printed pattern and reflected light is read with an optical sensor, and, based on a value of the reading, recording positions of dots (for example, landing positions of dots of a outbound path and a inbound path) are corrected (for example, see Patent Document 1).

Further, as a serial type inkjet printer that performs correction using such a method, a printer is known in which, by using a value obtained by reading with an optical sensor a recording medium on which a pattern is not printed and a value obtained by reading with an optical sensor a recording medium on which a pattern is printed, correction can be performed by suppressing influence of characteristics of the recording medium.

RELATED ART

[Patent Doc. 1] JP Laid-Open Patent Application Publication 2016-182679

[Patent Doc. 2] JP Laid-Open Patent Application Publication 2014-111326

However, in the conventional method, for example, when a recording medium having multiple regions having different light reflection characteristics, such as a recording medium on which a regular pattern is formed or a recording medium having retroreflection characteristics, there is a problem that a value obtained by reading a pattern with an optical sensor varies depending on how the pattern overlaps the regions, and recording positions of dots cannot be appropriately corrected.

The present invention is accomplished in view of the above problem and is intended to provide a recording apparatus and a correction method that allow recording positions of dots to be appropriately corrected even when a recording medium having multiple regions of which light reflection characteristics are different is used.

SUMMARY

A recording apparatus, disclosed in the application, includes: a recording head that records an image on a recording medium using a recording agent; a carrying part that carries the recording medium in a carrying direction of the recording medium; a carriage on which the recording head is mounted and that reciprocates in a main scanning direction orthogonal to the carrying direction; a detector that is mounted on the carriage and optically detects the image recorded on the recording medium; and a controller that obtains a correction value of recording positions of dots based on a detection result obtained by detecting with the detector a test pattern recorded on the recording medium by the recording head wherein the correction value is used when the image is recorded on the recording medium by the recording head, and, corrects the recording positions of the dots based on the correction value, wherein the test pattern includes an adjustment pattern and a reference pattern, the adjustment pattern includes multiple overlapping patterns that are each formed by overlapping two basic patterns, a shift amount of the two basic patterns in a relative movement direction of the recording medium and the recording head is different for each of the multiple overlapping patterns, the reference pattern is formed of predetermined patterns that each correspond to the multiple overlapping patterns, the correction value of recording positions of dots, which is obtained by the controller, is calculated based on adjustment detection results respectively obtained by detecting with the detector the multiple overlapping patterns forming the adjustment pattern and a reference detection result obtained by detecting with the detector the predetermined pattern forming the reference pattern, and the controller corrects the recording positions of dots based on the correction value.

Further, this application discloses a correction method in a recording apparatus, the recording apparatus includes: a recording head that records an image on a recording medium using a recording agent; a carrying part that carries the recording medium in a carrying direction of the recording medium; a carriage on which the recording head is mounted and that reciprocates in a main scanning direction orthogonal to the carrying direction; a detector that is mounted on the carriage and optically detects the image recorded on the recording medium; and a controller that corrects recording positions of dots when the recording head records the image on the recording medium, the image being formed with the dots, the correction method, comprising: a process in which the recording head records a test pattern on the recording medium; a process in which the detector detects the test pattern recorded on the recording medium; and a process in which, based on a detection result obtained from the detector, the controller obtains a correction value of the recording positions of dots, and the controller corrects the recording positions of dots based on the correction value, wherein the test pattern includes an adjustment pattern and a reference pattern, the adjustment pattern includes multiple overlapping patterns that are each formed by overlapping two basic patterns, a shift amount of the two basic patterns in a relative movement direction of the recording medium and the recording head is different for each of the multiple overlapping patterns, the reference pattern is formed of a predetermined pattern corresponding the multiple overlapping patterns, and, in the process of correcting the recording positions of dots, the controller obtains a correction value of the recording positions of dots based on detection results respectively obtained by detecting with the detector the multiple overlapping patterns forming the adjustment pattern and a detection result obtained by detecting with the detector the predetermined pattern forming the reference pattern, and corrects the recording positions of dots based on the correction value.

The dots of the invention means elements to form images or test patterns on the recording medium. The single dot may be defined as a minimal component of these images or patters, or as a single spot formed from a single drop of ink.

As a result, in the present invention, by simply setting the positional relationship between the corresponding overlapping patterns and predetermined pattern in accordance with the recording medium having multiple regions having different reflection characteristics, even when such a recording medium is used, the recording positions of the dots can be appropriately corrected.

Thus, according to the present invention, a recording apparatus and a correction method can be realized that allow recording positions of dots to be appropriately corrected even when a recording medium having multiple regions of which light reflection characteristics are different (or not the same) is used.

BRIEF DESCRIPTIONS OF THE DRAWINGS

DETAILED DESCRIPTIONS OF PREFERRED EMBODIMENTS

In the following, modes for carrying out the invention (hereinafter, these are referred to as "embodiments") are described in detail with reference to the drawings.

1. First Embodiment

1-1. Configuration of Main Part of Inkjet Printer

Figure 1:
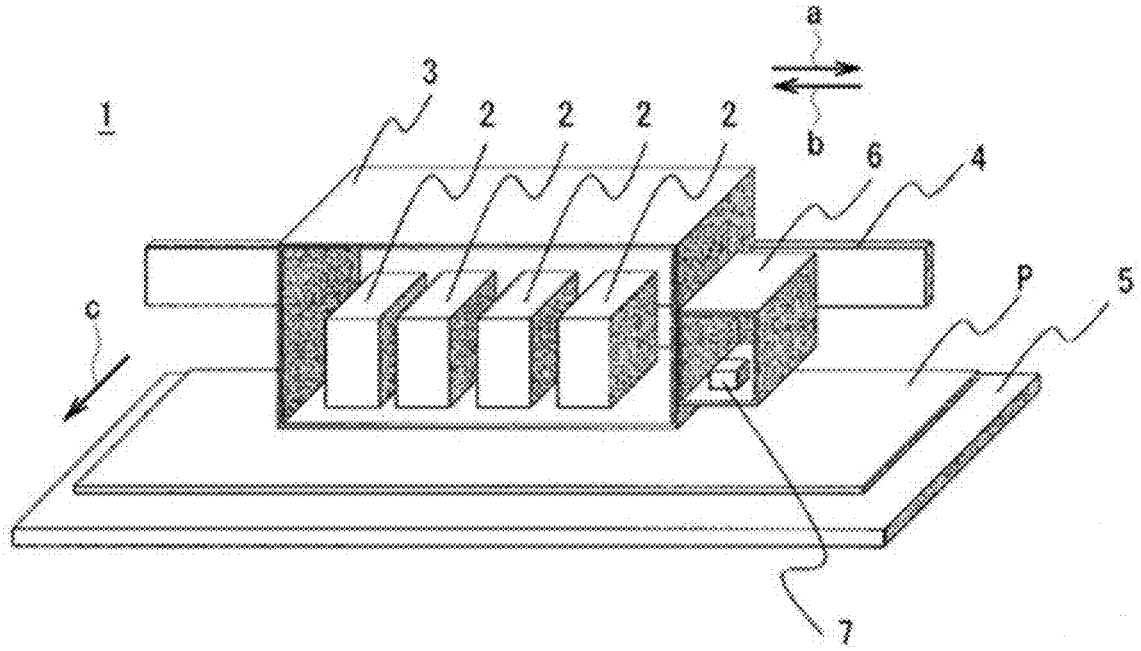
FIG. 1 is a perspective view illustrating a configuration of a main part of an inkjet printer according to a first embodiment.

FIG. 1 illustrates a configuration of a main part of an inkjet printer 1 (or recording apparatus) according to a first embodiment. The inkjet printer 1 has a carriage 3 holding multiple (for example, four) inkjet type recording heads 2, a rail 4 extending in a main scanning direction indicated by arrows a and b, and a platen 5 arranged along the rail 4.

The carriage 3 moves back and forth in the main scanning direction along the rail 4. The four inkjet type recording heads 2 held by the carriage 3 respectively correspond to, for example, four ink colors of cyan, magenta, yellow, and black, and are arranged side by side in the main scanning direction. The inkjet type recording heads 2 each have, for example, multiple nozzles arranged in the main scanning direction indicated by "arrows a" and "arrow b" and a sub-scanning direction indicated by an arrow c, and ink is discharged from each of the nozzles. In this invention, inks are one example of recording agent. Toner or other developers may be used for the recording agent.

The platen 5 is a metallic flat plate, and a recording medium P is placed on a surface of the platen 5 opposing the carriage 3. The platen 5 is provided with multiple suction holes (not illustrated in the drawings) on the surface thereof, and the recording medium P is fixed on the surface due to suction. Further, a heater wire (not illustrated in the drawings) is provided on a back side of the platen 5, and the platen 5 is heated.

A sensor unit 6 is provided on one side of the carriage 3 in the main scanning direction. The sensor unit 6 holds a detector 7 having an optical sensor. The detector 7 will be described in detail later.

The configuration of the main part of the inkjet printer 1 is as described above. In the inkjet printer 1, the recording medium P on the platen 5 is carried little by little in a medium carrying direction which is the same as the sub-scanning direction, and inks are discharged from the inkjet type recording heads 2 while the carriage 3 is moved back and forth in the main scanning direction, and thereby, printing (recording of an image) on the recording medium P is performed.

1-2. Configurations of Sensor Unit and Recording Medium

Figure 2:
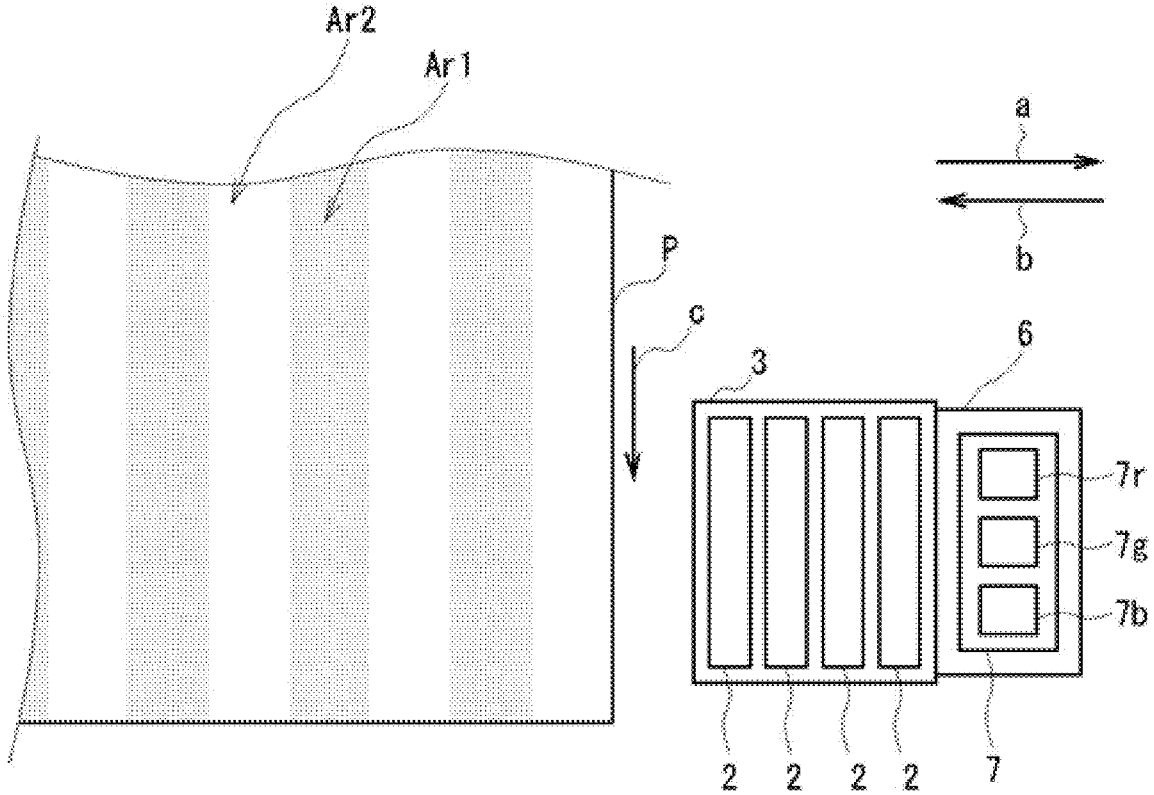
FIG. 2 is a top view of a sensor unit and a recording medium according to the first embodiment.

Next, configurations of the sensor unit 6 and the recording medium P are described in detail using FIG. 2. FIG. 2 is a top view of the sensor unit 6 and the recording medium P. As illustrated in FIG. 2, in the detector 7 held by the sensor unit 6, an R detector 7*r*, a G detector 7*g* and a B detector 7*b* are linearly arranged along the medium carrying direction indicated by "arrow c."

The R detector 7*r*, the G detector 7*g* and the B detector 7*b* are optical sensors that respectively radiate R (red), G (green) and B (blue) light beams to the recording medium P and detect (read) reflection intensities of the light beams as image densities. In the detector 7, the R detector 7*r* is used for detecting a cyan density, the G detector 7*g* is used for detecting a magenta density, and the B detector 7*b* is used for detecting a yellow or black density. In this way, in the detector 7, by using light of a color close to a complementary color with respect to an ink color, sensitivity for detecting a density is improved.

On the other hand, the recording medium P is one of recording mediums that can be used for printing by the inkjet printer 1, and, for example, multiple first patterns Ar1 and multiple second patterns Ar2 each extending in a strip shape along the medium carrying direction are formed so as to be periodically and alternately arranged in the main scanning direction indicated by the arrows a and b.

The first patterns Ar1 and the second patterns Ar2 are regions formed by structures or materials of the recording medium P, and have different light reflection characteristics. Specifically, when there are regions having different structures in the recording medium P, the light reflection characteristics are the same in regions having the same structure, and, on the other hand, the light reflection characteristics are different in regions having different structures. Further, when there are regions having the same structure but different materials in the recording medium P, the light reflection characteristics are the same in regions having the same material, and, on the other hand, the light reflection characteristics are different in regions having different materials.

In this way, since the first patterns Ar1 and the second patterns Ar2 are different in light reflection characteristics, detection results of the detector 7 are affected by the first patterns Ar1 and the second patterns Ar2. The configurations of the sensor unit 6 and the recording medium P are as described above. As will be described in detail later, in the present embodiment, even when such a recording medium P having regions having different light reflection characteristics is used, recording positions of dots with respect to the recording medium P can be corrected. In the inkjet printer 1, the dots are ink droplets discharged onto the recording medium P, and the recording positions of the dots are landing positions of the ink droplets.

1-3. Overall Configuration of Inkjet Printer

Figure 3:
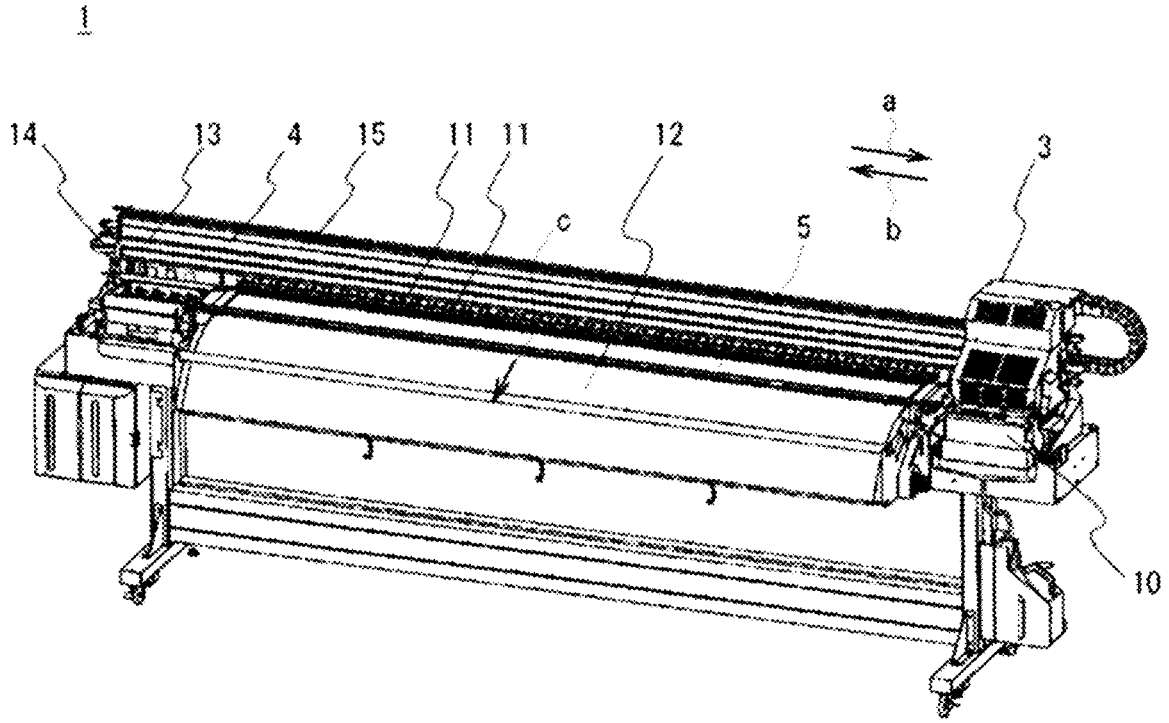
FIG. 3 is an external view of an overall configuration of the inkjet printer according to the first embodiment.

Next, an overall configuration of the inkjet printer 1 is described using FIG. 3. FIG. 3 is an external view of the overall configuration of the inkjet printer 1. The inkjet printer 1 includes: a cap unit 10 that seals the inkjet type recording heads 2 (omitted in FIG. 3) held by the carriage 3 by covering nozzle faces of the inkjet type recording heads 2; carrying rollers 11 that carries the recording medium P (omitted in FIG. 3); an after guide 12 that guides the recording medium P; an endless belt 13 that moves the carriage 3; a drive motor 14 that causes the endless belt 13 to move; and a linear scale 15 for detecting a position of the carriage 3.

The cap unit 10 seals the inkjet type recording heads 2 so that the inkjet type recording heads 2 are not dried, and periodically sucks inks from the inkjet type recording heads 2 for maintenance.

The multiple carrying rollers 11 are arranged along the rail 4. The carrying rollers 11 include drive rollers (on a lower side) and pinch rollers (on an upper side), which are arranged such that the drive rollers respectively oppose the pinch rollers in an up-down direction, and the recording medium P is carried in a state of being sandwiched between the drive rollers and the pinch rollers due to rotation of the drive rollers.

The after guide 12 is a curved metal plate that guides the recording medium P carried by the carrying rollers 11, and is provided on a downstream side of the platen 5 in the medium carrying direction. Further, a pre-guide (not illustrated in the drawings) is provided on an upstream side of the platen 5 in the medium carrying direction. Similar to the platen 5, heater wires (not illustrated in the drawings) are respectively provided on back sides of the after guide 12 and the pre-guide to heat the after guide 12 and the pre-guide.

In this way, in the inkjet printer 1, by heating the platen 5, the after guide 12 and the pre-guide, the recording medium P guided by these members is heated to a suitable temperature so as to facilitate fusion of ink onto the recording medium P.

The endless belt 13 is connected to the carriage 3 and is further wound around pulleys (not illustrated in the drawings). The drive motor 14 is connected to the endless belt 13. In the inkjet printer 1, by driving the drive motor 14 to cause the endless belt 13 to move, the carriage 3 connected to the endless belt 13 is caused to move along the rail 4 in a direction indicated by the arrow a or in a direction indicated by the arrow b.

Scale marks are formed on the linear scale 15. By reading the scale marks, the position of the carriage 3 can be detected. Specifically, a linear encoder (to be described later) mounted on the carriage 3 reads the scale marks of the linear scale 15. The overall configuration of the inkjet printer 1 is as described above.

1-4. System Configuration of Inkjet Printer

Figure 4:
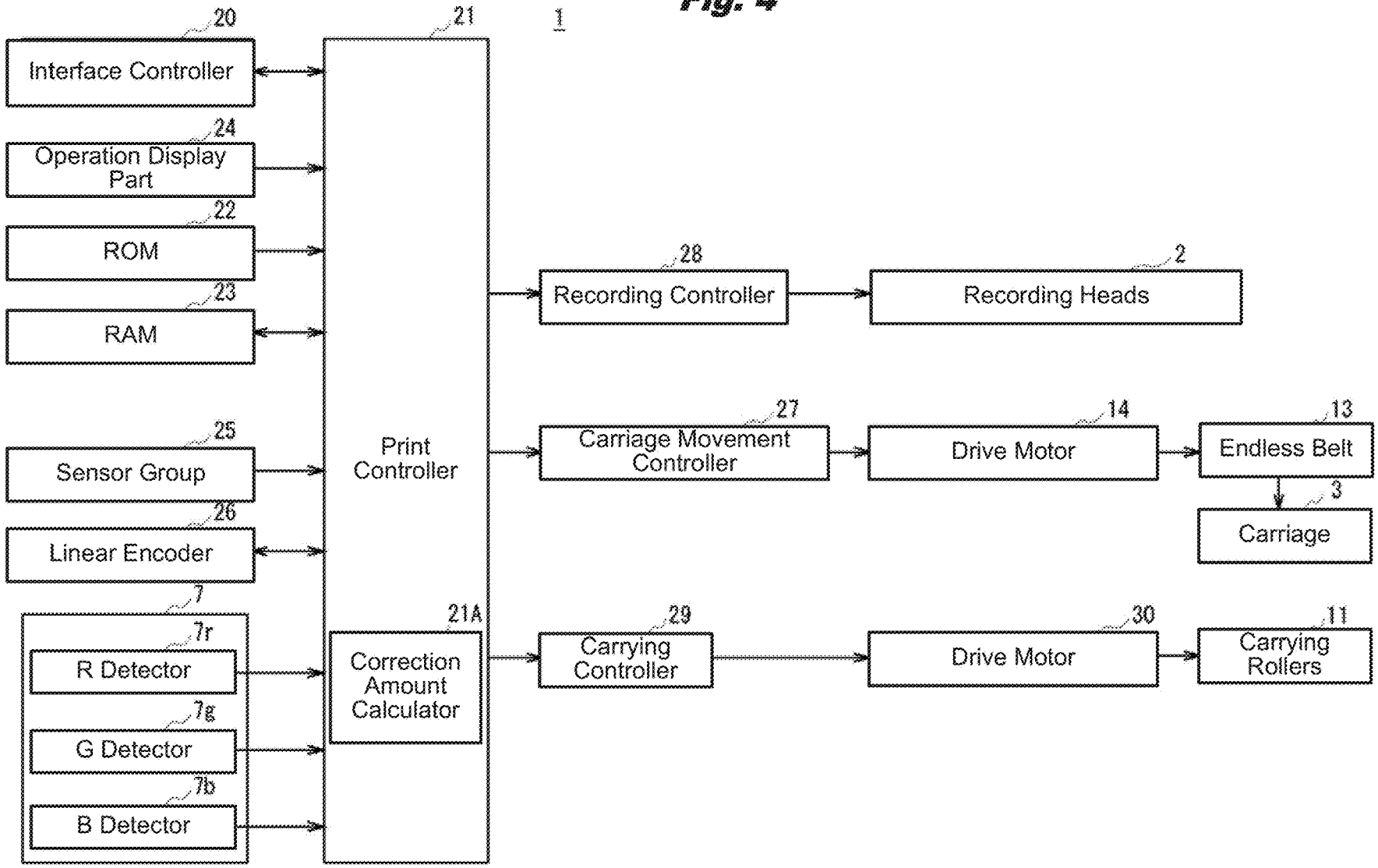
FIG. 4 is a block diagram illustrating a system configuration of the inkjet printer according to the first embodiment.

Next, a system configuration of the inkjet printer 1 is described using a block diagram illustrated in FIG. 4. as illustrated in FIG. 4, the inkjet printer 1 includes, as a system configuration, an interface controller 20, a print controller 21, a ROM 22, a RAM 23, an operation display part 24, a sensor group 25, a linear encoder 26, the detectors 7 (R Detector 7*r*, G Detector 7*g*, B Detector 7*b*), a carriage movement controller 27, the drive motor 14, the endless belt 13, the carriage 3, a recording controller 28, the inkjet type recording heads 2, a carrying controller 29, a drive motor 30, and the carrying rollers 11. They are components to configure the system.

The interface controller 20 receives print data and a control command from a host device (not illustrated in the drawings) and passes the print data and the control command to the print controller 21. The print controller 21, together with the ROM 22, the RAM 23, and an input/output port, a timer and the like (not illustrated in the drawings), is configured as a microprocessor. When the print controller 21 receives the print data and the control command via the interface controller 20, the print controller 21 controls an entire sequence of the inkjet printer 1 according to a program read from the ROM 22 to perform a print operation. Further, the print controller 21 also has a function as a correction amount calculator 21A for calculating a correction amount when the recording positions of the dots with respect to the recording medium P are corrected.

The operation display part 24 includes a display part displaying a state of the inkjet printer 1 and an operation part accepting a user operation with respect to the inkjet printer 1. The sensor group 25 includes various sensors for monitoring an operation state of the inkjet printer 1, and includes, for example, a medium position detection sensor, a temperature and humidity sensor and the like.

The ROM 22 is a non-volatile memory that stores a program executed by the print controller 21 and various initial setting values of the inkjet printer 1. The ROM 22 stores data of test patterns (details will be described later) to be used when the recording positions of the dots with respect to the recording medium P are corrected. Multiple test patterns are stored in the ROM 22, and one of the test patterns is read out and used by the print controller 21. The RAM 23 is a work memory used by the print controller 21 during computation or a memory used as a temporary storage part for various kinds of information.

The linear encoder 26 optically detects the scale marks of the linear scale 15 illustrated in FIG. 3. The linear encoder 26 operates based on a control signal from the print controller 21 and subjects a detection result to analog-to-digital conversion and outputs a result of the analog-to-digital conversion to the print controller 21. The print controller 21 can determine the position of the carriage 3 by counting outputs of the linear encoder 26, and performs various kinds of control such as ink discharging according to the position of the carriage 3.

The carriage movement controller 27 moves the carriage 3 in the main scanning direction by driving the drive motor 14 (see FIG. 3) to cause the endless belt 13 to move. The recording controller 28 drives the inkjet type recording heads 2 according to an instruction from the print controller 21. The carrying controller 29 carries the recording medium P by driving the drive motor 30 (omitted in FIG. 3) to rotate the carrying rollers 11 (specifically, to rotate the drive rollers of the carrying rollers 11). The print controller 21 may have one or more functions of the carriage movement controller 27, the recording controller 28 and the carrying controller 29.

The detector 7 subjects detection results of the R detector 7*r*, the G detector 7*g* and the B detector 7*b* to analog-to-digital conversion and outputs results of the analog-to-digital conversion to the print controller 21. The system configuration of the inkjet printer 1 is as described above.

1-5. Print Operation of Inkjet Printer

Next, a print operation of the inkjet printer 1 is described with reference to FIGS. 1-4. The print operation of the inkjet printer 1 is an operation mainly performed by the print controller 21.

When a print command including print data and a control command is input from a host device (not illustrated in the drawings) such as a personal computer, the print controller 21 rotates the drive rollers of the carrying rollers 11 by driving the drive motor 30 via the carrying controller 29. As a result, the recording medium P sandwiched between the drive rollers and the pinch rollers of the carrying rollers 11 is carried in the medium carrying direction.

Further, the print controller 21 moves the carriage 3 fixed to the endless belt 13 back and forth in the main scanning direction by driving the drive motor 14 via the carriage movement controller 27. In this case, the print controller 21 determines the position of the carriage 3 by counting outputs from the linear encoder 26, and performs printing (forms an image) on the recording medium P via the recording controller 28 by discharging inks from the inkjet type recording heads 2 at an arbitrary timing in accordance with the position of the carriage 3. The print operation of the inkjet printer 1 is as described above.

1-6. Correction of Recording Positions of Dots by Inkjet Printer

Next, correction of the recording positions of the dots by the inkjet printer 1 is described in detail using FIGS. 5-12. Here, in the inkjet printer 1, as the correction of the recording positions of the dots, the landing positions of the dots in a outbound path and a inbound path when the carriage 3 is moved back and forth are corrected, and a medium carrying amount when the recording medium P is carried is corrected (that is, the landing positions of the dots when the medium is carried are corrected). These corrections are performed before actual printing on the recording medium P is performed.

In the application, the correction of recording positions may be termed a correction process, and the actual printing may be termed a normal print process. In the normal recording process (or normal print process), inks are to be discharged at recording positions, which are previously set, or a recording medium is to be carried by a predetermined medium carrying amount (or carrying distance), which is previously set. By executing the correction process, the recording positions and/or the medium carrying amount are corrected. After that, the normal print process is executed with the corrected recording positions/corrected medium carrying amount. These recording positions and/or the medium carrying amount may be termed as a normal recording setting (or normal print setting). The setting is corrected based on one or several detection results obtained with the detector in one embodiment.

Figure 5A:
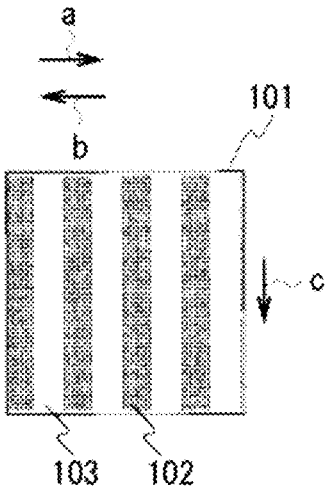
FIGS. 5A-5C are diagrams illustrating a configuration of a test pattern used for correcting landing positions of dots of a outbound path and a inbound path according to the first embodiment.
Figure 5B:
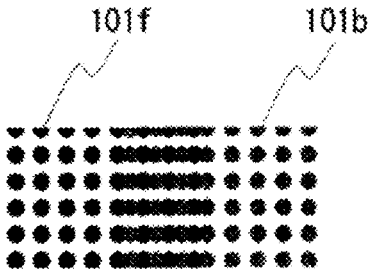
Figure 5C:
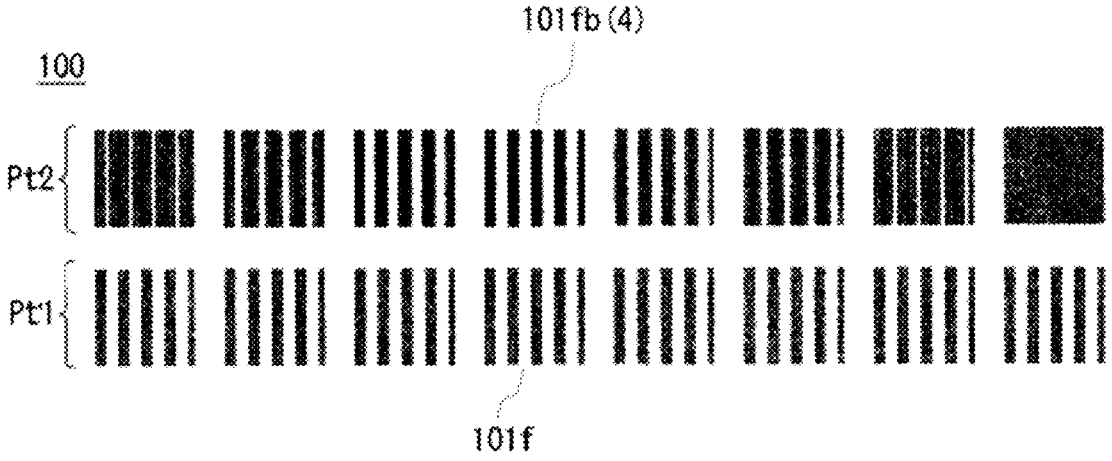

First, a test pattern 100 used for correcting the landing positions of the dots in the outbound path and the inbound path is described in detail using FIGS. 5A-5C. FIG. 5A illustrates a basic pattern 101 that forms the test pattern 100. FIG. 5B illustrates overlapping between a basic pattern 101 (referred to as 1010 printed in the outbound path and a basic pattern 101 (referred to as 101*b*) printed in a inbound path. FIG. 5C illustrates the test pattern 100 formed by multiple basic patterns 101.

The basic pattern 101 illustrated in FIG. 5A is a pattern in which multiple discharge portions 102 and multiple non-discharge portions 103, each of which extends in a strip shape along the medium carrying direction (a downward direction in the figure) indicated by the arrow c, are alternately arranged in the main scanning direction (a left-right direction in the figure) indicated by the arrows a and b. The discharge portions 102 are portions to which ink adheres; and the non-discharge portions 103 are portions to which ink does not adhere. Here, a size (number of dots) of each of the discharge portions 102 in the main scanning direction and a size (number of dots) of each of the non-discharge portions 103. in the main scanning direction are equal to each other.

The test pattern 100 illustrated in FIG. 5C includes a reference pattern Pt1 and an adjustment pattern Pt2, which are adjacent to each other in the medium carrying direction. The reference pattern Pt1 is a pattern printed only in the outbound path, and is a pattern in which multiple (for example, 8) basic patterns 101*f* printed in the outbound path are arranged at intervals in the main scanning direction.

The adjustment pattern Pt2 is a pattern printed in the outbound path and the inbound path, and is a pattern in which multiple (for example, same as in the reference pattern Pt1, 8) overlapping patterns 101*fb* are arranged at intervals in the main scanning direction, the overlapping patterns 101*fb* being each formed by one basic pattern 101*f* and one basic pattern 101*b* that are overlappingly printed in the outbound path and the inbound path. The overlapping patterns 101*fb* of the adjustment pattern Pt2 are arranged such that positions thereof in the main scanning direction are respectively aligned with those of the basic patterns 101*f* of the reference pattern Pt1.

The eight overlapping patterns 101*fb* are obtained by stepwise shifting, in the main scanning direction, the positions of the discharge portions 102 of the basic patterns 101*b* of the inbound path with respect to the positions of the discharge portions 102 of the basic patterns 101*f* of the outbound path. Specifically, among the eight overlapping patterns 101*fb*, the overlapping pattern 101*fb* (referred to as 101*fb* (4)) positioned 4th from left in the figure is set to have a shift amount of 0; the 3 overlapping patterns 101*fb* positioned on a left side of the overlapping pattern 101*fb* (4) in the figure are respectively set to have shift amounts of +1, +2 and +3 on a plus side; and the 4 overlapping patterns 101*fb* positioned on a right side of the overlapping pattern 101*fb* (4) in the figure are respectively set to have shift amounts of −1, −2, −3 and −4 on a minus side.

When such an adjustment pattern Pt2 is printed, first, in the outbound path, the eight basic patterns 101*f* are printed without changing the discharge timings of the inkjet type recording heads 2. Next, in the inbound path, the eight basic patterns 101*b* are printed while the discharge timings of the inkjet type recording heads 2 are adjusted according to the shift amounts set for the overlapping patterns 101*fb*.

In this case, for the overlapping pattern 101*fb* (4) for which the shift amount is set to 0, the discharge timing in the inbound path is set to an initial setting value stored in the ROM 22. Further, for the overlapping patterns 101*fb* for which the shift amounts are set to the plus side, the discharge timings in the inbound path are respectively set to values shifted to the plus side by the shift amounts from initial setting values. Further, for the overlapping patterns 101*fb* for which the shift amounts are set to the minus side, the discharge timings in the inbound path are respectively set to values shifted to the minus side by the shift amounts from initial setting values.

Here, the unit of the shift amounts of the adjustment patterns Pt2 is set to a predetermined number of dots. That is, for example, when a shift amount is +2, it means that it is shifted to the plus side by the predetermined number of dots×2.

In the adjustment pattern Pt2, since one basic pattern 101*b* is overlappingly printed on one basic pattern 101*f* for each of the overlapping patterns 101*fb* in the outbound path and the inbound path, when the landing positions of the dots match in the outbound path and the inbound path and the basic pattern 101*b* exactly overlaps the basic pattern 101*f*, an area of the dots per unit area is reduced and a density is lowered. On the other hand, when shifts in the landing positions of the dots increase in the outbound path and the inbound path, the area of the dots per unit area increases and the density increases.

Then, in the adjustment pattern Pt2, the shift amount set for the overlapping pattern 101*fb* that has the lowest density among the overlapping patterns 101*fb* represents the shift amount of the landing positions of the dots of the outbound path and the inbound path. For example, when the density of the overlapping pattern 101*fb* that is set to have the shift amount of +1 is the lowest among the actually printed overlapping patterns 101*fb*, it means that the landing positions of the dots of the outbound path and the inbound path are shifted to the plus side by the predetermined number of dots×1 with reference to the case where the discharge timings are set to the initial setting values.

Therefore, when the densities of the overlapping patterns 101*fb* can be accurately detected, the shift amount of the landing positions of the dots of the outbound path and inbound path can be detected, and the landing positions of the dots of the outbound path and the inbound path can be appropriately corrected. The test pattern 100 used for correcting the landing positions of the dots of the outbound path and the inbound path is as described above.

Figure 6A:
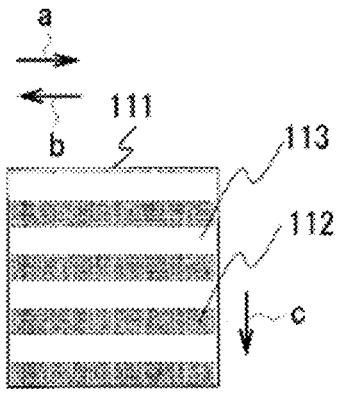
FIGS. 6A-6C are diagrams illustrating a configuration of a test pattern used for correcting a medium carrying amount according to the first embodiment.
Figure 6B:
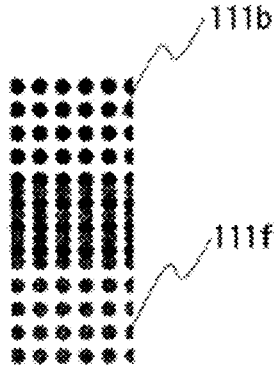
Figure 6C:
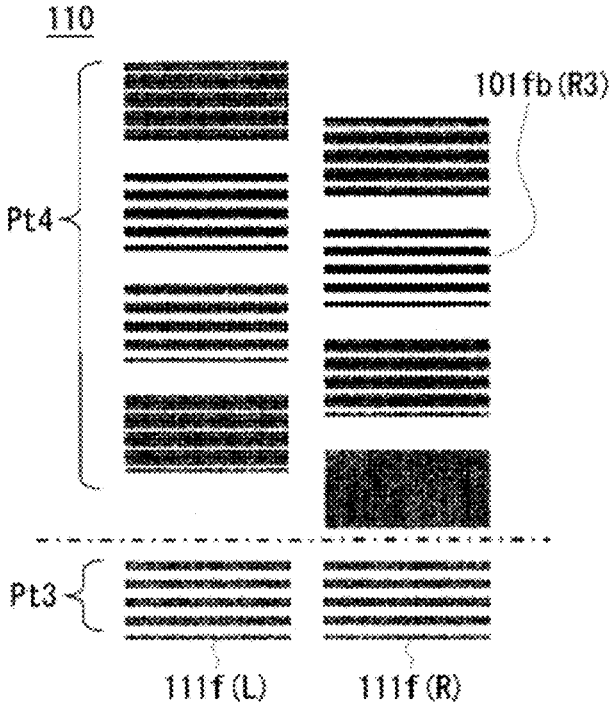

Next, a test pattern 110 used for correcting the medium carrying amount is described in detail using FIGS. 6A-6C. FIG. 6A illustrates a basic pattern 111 that forms the test pattern 110. FIG. 6B illustrates overlapping between a basic pattern 111 (referred to as 1110 printed in the outbound path before the recording medium P is carried and a basic pattern 111 (referred to as 111*b*) printed in the inbound path after the recording medium P is carried. FIG. 6C illustrates the test pattern 110 formed by multiple basic patterns 111.

The basic pattern 111 illustrated in FIG. 6A is a pattern in which multiple discharge portions 112 and multiple non-discharge portions 113, each of which extends in a strip shape along the main scanning direction (the left-right direction in the figure) indicated by the arrows a and b, are alternately provided in the medium carrying direction (the downward direction in the figure) indicated by the arrow c. Here, a size (number of dots) of each of the discharge portions 112 in the medium carrying direction and a size (number of dots) of each of the non-discharge portions 113. in the medium carrying direction are equal to each other.

The test pattern 110 illustrated in FIG. 6C includes a reference pattern Pt3 and an adjustment pattern Pt4, which are adjacent to each other in the medium carrying direction. The reference pattern Pt3 is a pattern in which multiple (for example, 2) basic patterns 111*f* are arranged at intervals in the main scanning direction.

The adjustment pattern Pt4 is a pattern in which a basic pattern 111*f* and a basic pattern 111*b*, which are respectively overlappingly printed before and after the recording medium P is carried, are taken as one overlapping pattern 111*fb* and multiple (for example, 8) overlapping patterns 111*fb* are arranged in a staggered pattern along the medium carrying direction. Specifically, of the eight overlapping patterns 111*fb*, the four overlapping patterns 111*fb* on the left side in the figure are arranged in the medium carrying direction such that positions thereof in the main scanning direction are aligned with that of the basic pattern 111*f* (referred to as 111*f* (L)) of the reference pattern Pt3 on the left side in the figure, and the four overlapping patterns 111*fb* on the right side in the figure are arranged in the medium carrying direction such that positions thereof in the main scanning direction are aligned with that of the basic pattern 111*f* (referred to as 111*f* (R)) of the reference pattern Pt3 on the right side in the figure.

That is, the adjustment pattern Pt4 has two columns of overlapping patterns 111*fb*, each column having four overlapping patterns 111*fb* arranged in the medium carrying direction with the positions thereof in main scanning direction aligned with each other. Further, the four overlapping patterns 111*fb* of the left column in the figure and the four overlapping patterns 111*fb* of the right column in the figure are arranged such that the positions thereof in the medium carrying direction are shifted with respect to each other.

Here, by setting the test pattern 110 to have two columns in the main scanning direction, as compared to a test pattern 110 having one column, a usage amount of the recording medium P when the test pattern 110 is printed is reduced. However, depending on a carrying amount of the recording medium P and a swath width of the inkjet type recording heads 2, the test pattern 110 can also be set to have three or more columns.

The eight overlapping patterns 111*fb* are obtained by stepwise shifting, in the medium carrying direction, the positions of the discharge portions 112 of the basic patterns 111*b* after the carrying with respect to the positions of the discharge portions 112 of the basic patterns 111*f* before the carrying. Specifically, among the eight overlapping patterns 111*fb*, the overlapping pattern 111*fb* (referred to as 111*fb* (R3)) positioned 3rd from the bottom of the right column in the figure is set to have a shift amount of 0; the 3 overlapping patterns 111*fb* positioned on an upper side of the overlapping pattern 111*fb* (R3) in the figure are respectively set to have shift amounts of +1, +2 and +3 on a plus side; and the 4 overlapping patterns 111*fb* positioned on a lower side of the overlapping pattern 111*fb* (R3) in the figure are respectively set to have shift amounts of −1, −2, −3 and −4 on a minus side.

When such an adjustment pattern Pt4 is printed, for each overlapping pattern 111*fb*, first, a basic pattern 111*f* is printed, and next, the recording medium P is carried by a carrying amount adjusted to match a shift amount set for the each overlapping pattern 111*fb* and then a basic pattern 111*b* is printed.

In this case, for the overlapping pattern 111*fb* (R3) for which the shift amount is set to 0, the carrying amount is set to an initial setting value stored in the ROM 22. Further, for the overlapping patterns 111*fb* for which the shift amounts are set to the plus side, the carrying amounts are respectively set to values shifted to the plus side by the shift amounts from initial setting values. Further, for the overlapping patterns 111*fb* for which the shift amounts are set to the minus side, the carrying amounts are respectively set to values shifted to the minus side by the shift amounts from initial setting values.

Here, the unit of the shift amounts of the adjustment patterns Pt4 is set to a predetermined number of dots. This predetermined number of dots is set separately from the predetermined number of dots set for the adjustment pattern Pt2 of the test pattern 100.

Further, in the inkjet printer 1, after a basic pattern 111*f* is printed and the recording medium P is carried, a basic pattern 111*b* is printed by shifting discharging positions of the inkjet type recording heads 2 in the medium carrying direction by a carrying amount of an initial setting value. By doing so, the positions of the discharge portions 112 of the basic pattern 111*b* after the carrying can be shifted stepwise in the medium carrying direction with respect to the positions of the discharge portions 112 of the basic pattern 111*f* before the carrying.

In the adjustment pattern Pt4, the shift amount set for the overlapping pattern 111*fb* that has the lowest density among the overlapping patterns 111*fb* represents the shift amount of the medium carrying amount. Therefore, when the densities of the overlapping patterns 111*fb* can be accurately detected, the shift amount of the medium carrying amount can be detected, and the medium carrying amount can be appropriately corrected. The test pattern 110 used for correcting the medium carrying amount is as described above.

Figure 7:
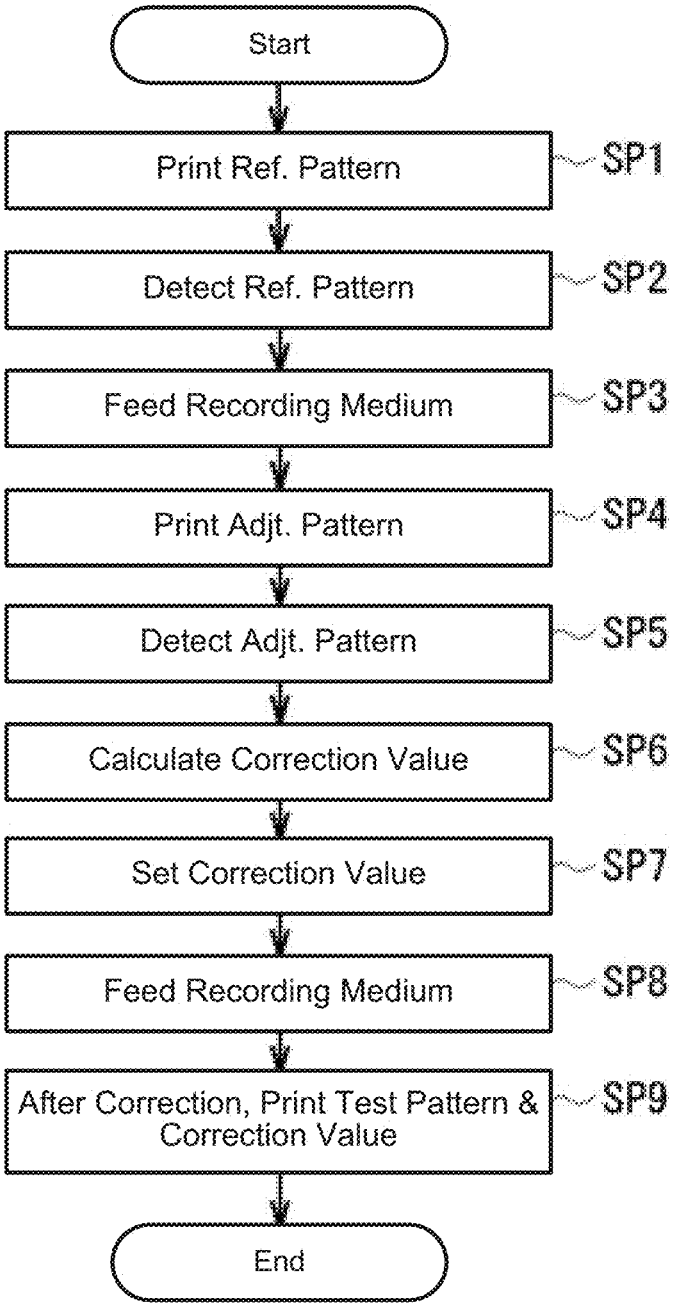
FIG. 7 is a flow diagram illustrating an operation procedure for correcting the landing positions of the dots of the outbound path and the inbound path according to the first embodiment.

Next, an outline of an operation for correcting the landing positions of the dots of the outbound path and the inbound path is described using a flow diagram illustrated in FIG. 7. This operation is mainly performed by the print controller 21.

In a step SP1, the print controller 21 prints the reference pattern Pt1 on the recording medium P with a predetermined color. In a subsequent step SP2, the print controller 21 moves the detector 7 to above the reference pattern Pt1 printed on the recording medium P, and uses the detector 7 to detect the densities of the eight basic patterns 101*f* that form the reference pattern Pt1. In this case, in the detector 7, the densities of the basic patterns 101*f* are each detected multiple times. In the print controller 21, an average value of the multiple densities detected for each basic pattern 101*f* is stored in the RAM 23 as a density value for the each basic pattern 101*f*.

In a subsequent step SP3, the print controller 21 feeds (carries) the recording medium P by a predetermined amount. In a subsequent step SP4, the print controller 21 prints the adjustment pattern Pt2 on the recording medium P. In a subsequent step SP5, the print controller 21 moves the detector 7 to above the adjustment pattern Pt2 printed on the recording medium P, and uses the detector 7 to detect the densities of the eight overlapping patterns 101*fb* that form the adjustment pattern Pt2. In this case, in the detector 7, the densities of the overlapping patterns 101*fb* are each detected multiple times. In the print controller 21, an average value of the multiple densities detected for each overlapping pattern 101*fb* is stored in the RAM 23 as a density value for the each overlapping pattern 101*fb*.

In a subsequent step SP6, the print controller 21 reads out the density values of the basic patterns 101*f* and the density values of the overlapping patterns 101*fb*, which are stored in the RAM 23, and, based on these density values, uses the correction amount calculator 21A to perform calculation, and, thereby, determines a correction value for correcting the landing positions of the dots of the outbound path and the inbound path (that is, a correction value for correcting the discharge timings). A calculation method for this case will be described later.

In a subsequent step SP7, the print controller 21 sets the correction value determined in the step SP6 to the recording controller 28. As a result, using the correction value, the recording controller 28 can correct the landing positions of the dots of the outbound path and the inbound path by controlling the discharge timings of the inkjet type recording heads 2.

In a subsequent step SP8, the print controller 21 feeds the recording medium P, and sets an unused recording medium P on the platen 5. In a subsequent step SP9, in a state in which the landing positions of the dots of the outbound path and the inbound path have been corrected using the correction value, the print controller 21 prints the test pattern 100 and the correction value on the recording medium P. Here, it is also possible that a user looks at the printed test pattern 100 and the correction value and determines that the correction value needs to be corrected, and inputs a new correction value to the inkjet printer 1 via the operation display part 24. In this case, the print controller 21 sets the input correction value as a final correction value to the recording controller 28. The outline of the operation for correcting the landing positions of the dots of the outbound path and the inbound path is as described above. When the correction value is input, the set timing to discharge inks is corrected in accordance with the input correction value. The normal print process is executed with the corrected set timing to discharge inks.

Figure 8:
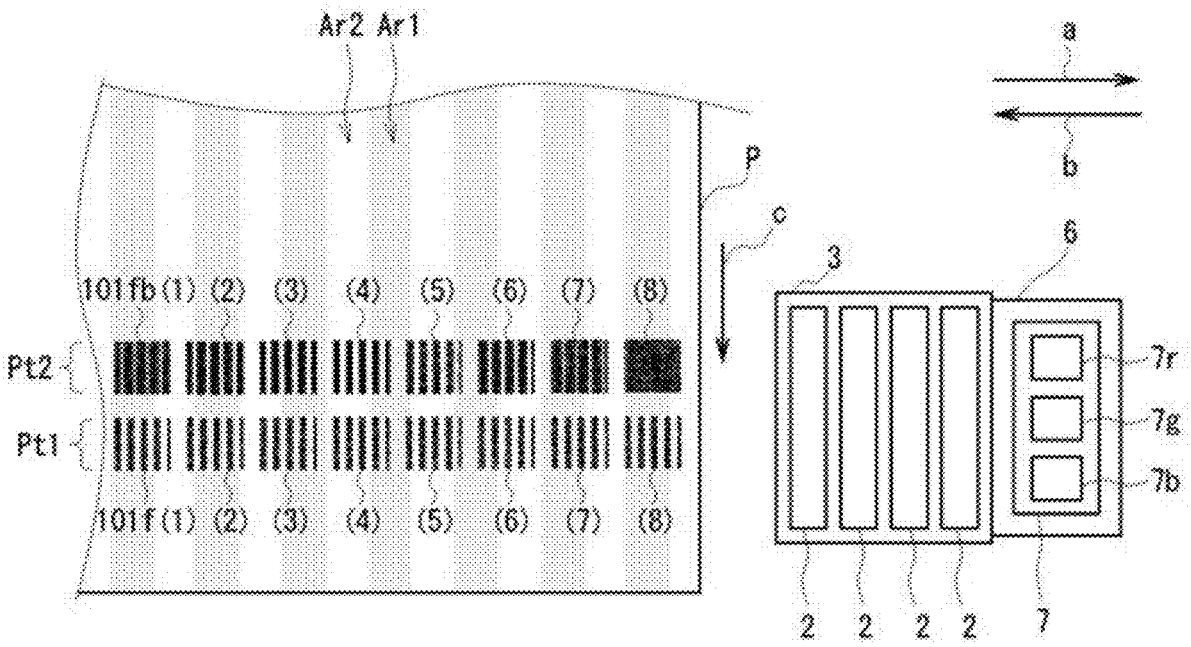
FIG. 8 illustrates a positional relationship between first patterns and second patterns formed in the recording medium and a reference pattern and an adjustment pattern printed on the recording medium for correcting the landing positions of the dots of the outbound path and the inbound path according to the first embodiment.
Figure 9A:
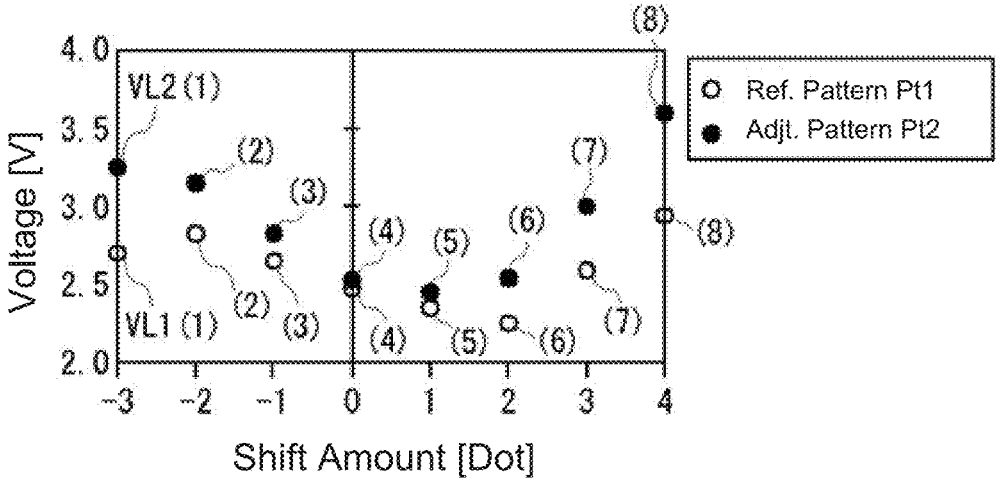
FIGS. 9A and 9B are graphs illustrating voltage values detected from the reference pattern and the adjustment pattern for correcting the landing positions of the dots of the outbound path and the inbound path according to the first embodiment, and differences in voltage values between the adjustment pattern and the reference pattern.
Figure 9B:
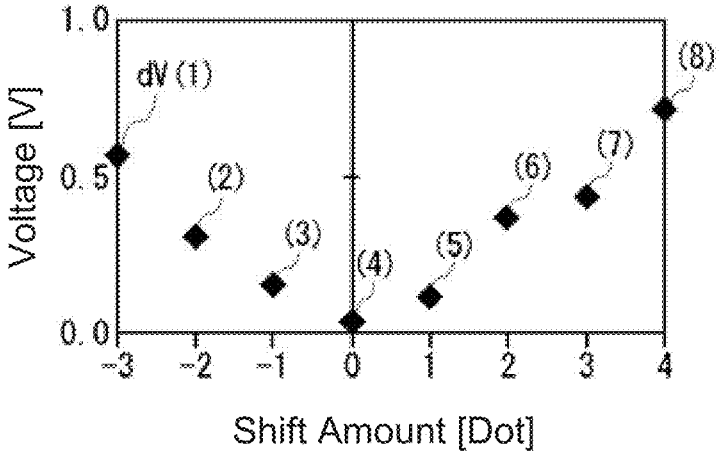

Next, the method for the calculation of the correction value performed in the above-described step SP5 is described using FIGS. 8, 9A and 9B.

FIG. 8 illustrates a positional relationship between the first patterns Ar1 and second patterns Ar2 formed in the recording medium P and the reference pattern Pt1 and adjustment pattern Pt2 printed as the test pattern 100 on the recording medium P. The reference pattern Pt1 is formed of eight basic patterns 101*f* (1)-101*f* (8) which are sequentially arranged from the left side in the figure, and the adjustment pattern Pt2 is formed of eight overlapping patterns 101*fb* (1)-101*fb* (8) which are sequentially arranged from the left side in the figure. In FIG. 8, the reference numeral symbols for the basic patterns 101*f* (2)-101*f* (8) are abbreviated to (2)-(8). Similarly, the reference numeral symbols for the overlapping patterns 101*fb* (2)-101*fb* (8) are also abbreviated to (2)-(8).

The basic patterns 101*f* (1)-101*f* (8) of the reference pattern Pt1 respectively correspond to the overlapping patterns 101*fb* (1)-101*fb* (8) of the adjustment pattern Pt2. For example, the basic pattern 101*f* (7) corresponds to the overlapping pattern 101*fb* (7).

The corresponding basic pattern 101*f* (7) and overlapping pattern 101*fb* (7) are printed at positions where they have the same positional relationship (overlapping state) with respect to the first patterns Ar1 and second patterns Ar2 formed in the recording medium P. Specifically, the corresponding basic pattern 101*f* (7) and overlapping pattern 101*fb* (7) are printed such that they are lined up in the medium carrying direction with their positions in the main scanning direction aligned with each other. As a result, of each of the corresponding basic pattern 101*f* (7) and overlapping pattern 101*fb* (7), for example, about half on the left side in the figure is positioned on a first pattern Ar1 and about half on the right side in the figure is positioned on a second pattern Ar2, their positional relationships (overlapping states) with respect to the first pattern Ar1 and second pattern Ar2 are the same.

In this way, the corresponding basic pattern 101*f* (7) and overlapping pattern 101*fb* (7) are printed at positions where their positional relationships (overlapping states) with respect to the first pattern Ar1 and second pattern Ar2 are the same, and thus, the corresponding basic pattern 101*f* (7) and overlapping pattern 101*fb* (7) are printed at positions where the light reflection characteristics are substantially the same.

Similarly, any other corresponding basic pattern 101*f* and overlapping pattern 101*fb* are also printed such that their positions in the main scanning direction are aligned with each other, and their positional relationships (overlapping states) with respect to the first patterns Ar1 and second patterns Ar2 are the same. The positional relationship between the first patterns Ar1 and second patterns Ar2 and the reference pattern Pt1 and adjustment pattern Pt2 is as described above.

Next, a graph of FIG. 9A illustrates an example of voltage values VL1 (1)-VL1 (8) as detection values (that is, density values) obtained by detecting with the detector 7 the densities of basic patterns 101*f* (1)-101*f* (8) forming the reference pattern Pt1 (Ref. Pattern in FIG. 9A) printed on the recording medium P and voltage values VL2 (1)-VL2 (8) as detection values (density values) obtained by detecting with the detector 7 the densities of the overlapping patterns 101*fb* (1)-(8) forming the adjustment pattern Pt2 (Adjt. Pattern in FIG. 9A).

FIG. 9A is a graph in which a vertical axis represents voltages and a horizontal axis represents the shift amounts set to the overlapping patterns 101*fb* (1)-101*fb* (8), and, on the graph, the voltage values VL1 (1)-VL1 (8) and the voltage values VL2 (1)-VL2 (8) are plotted. On the graph, the reference numeral symbols for the voltage values VL1 (2)-VL1 (8) are abbreviated to (2)-(8). Similarly, the reference numeral symbols for the voltage values VL2 (2)-VL2 (8) are abbreviated to (2)-(8).

As can be seen from this graph, for the voltage values VL2 (1)-VL2 (8) obtained from the adjustment pattern Pt2, the voltage value VL2 (5) detected from the overlapping pattern 101*fb* (5) having a shift amount of +1 is the lowest. That is, when it is determined only based on the voltage values VL2 (1)-VL2 (8), since the density of the overlapping pattern 101*fb* (5) is the lowest, the shift amount of the landing positions of the dots of the outbound path and the inbound path is +1.

However, the voltage values VL2 (1)-VL2 (8) are affected by the first patterns Ar1 and second patterns Ar2 formed in the recording medium P, and thus, do not necessarily represent accurate densities.

Therefore, in the present embodiment, by taking differences of the voltage values VL2 (1)-VL2 (8) detected from the adjustment pattern Pt2 respectively relative to the voltage values VL1 (1)-VL1 (8) detected from the reference pattern Pt1, the accurate densities can be detected. When the differences are dV (k) (k=1-8), the differences dV (k) can be determined from the following formula (1).

$$dV(k)=VL2(k)-VL1(k) \tag{1}$$

As described above, corresponding overlapping pattern 101*fb* and basic pattern 101*f* printed as the test pattern 100 have the same positional relationship with respect to the first patterns Ar1 and second patterns Ar2 formed in the recording medium P. Therefore, by taking the differences of the voltage values VL2 (1)-VL2 (8) detected from the overlapping patterns 101*fb* of the adjustment pattern Pt2 respectively relative to the voltage values VL1 (1)-VL1 (8) detected from the basic patterns 101*f* of the reference pattern Pt1, the influence of the first patterns Ar1 and the second patterns Ar2 can be eliminated from the voltage values VL2 (1)-VL2 (8), and the accurate densities can be obtained.

Here, the differences dV (1)-dV (8) are shown on a graph of FIG. 9B. As can be seen from this graph, for the differences dV (1)-dV (8), the difference dV (4) between the voltage value VL2 (4) and the voltage value VL1 (4) is the lowest. That is, when it is determined based on the differences dV (1)-dV (8), since the density of the overlapping pattern 101*fb* (4) having a shift amount of 0 is the lowest, the accurate shift amount of the landing positions of the dots of the outbound path and the inbound path in this case is 0. Using such a calculation method, the print controller 21 detects the shift amount of the landing positions of the dots of the outbound path and the inbound path, and, based on this shift amount, determines a correction value (that is, a correction value that set the shift amount to 0) for the landing positions of the dots of the outbound path and the inbound path.

Figure 10:
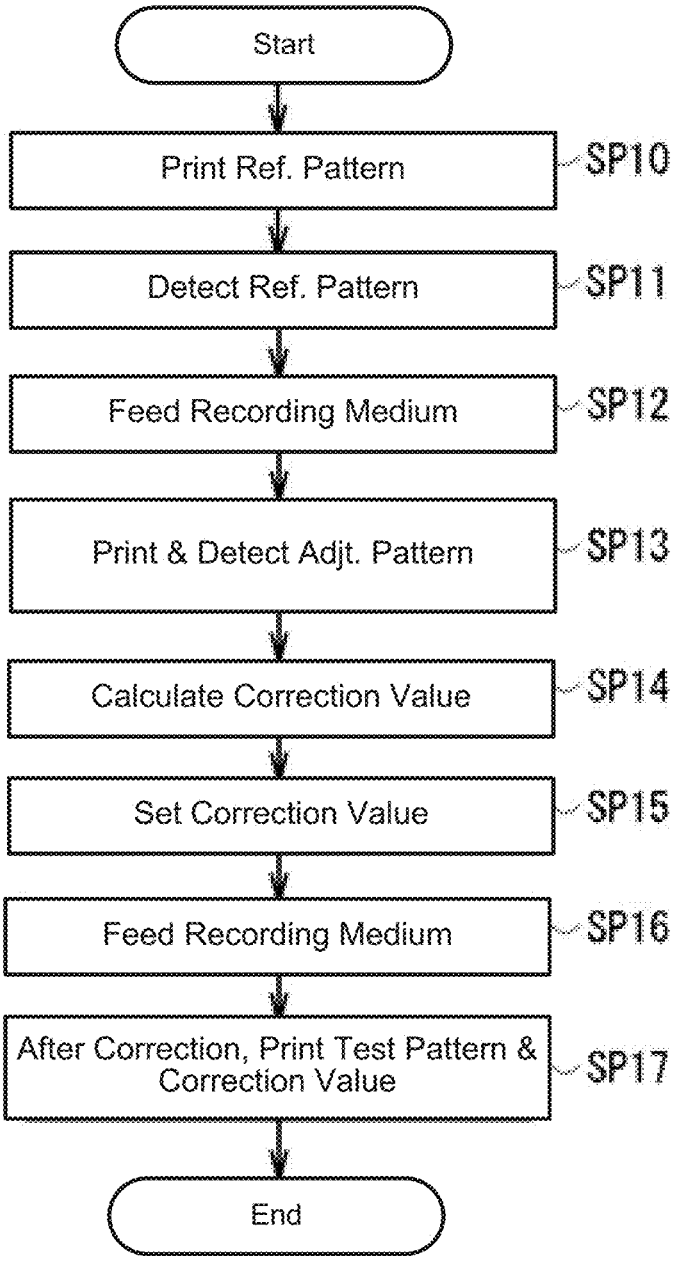
FIG. 10 is a flow diagram illustrating an operation procedure for correcting the medium carrying amount according to the first embodiment.

Next, an outline of an operation for correcting the medium carrying amount is described using a flow diagram illustrated in FIG. 10. This operation is also mainly performed by the print controller 21.

In a step SP10, the print controller 21 prints the reference pattern Pt3 on the recording medium P. In a subsequent step SP11, the print controller 21 moves the detector 7 to above the reference pattern Pt3 printed on the recording medium P, and uses the detector 7 to detect the densities of the two basic patterns 111*f* that form the reference pattern Pt3. In this case, in the detector 7, the densities of the basic patterns 111*f* are each detected multiple times. In the print controller 21, an average value of the multiple densities detected for each basic pattern 111*f* is stored in the RAM 23 as a density value for the each basic pattern 111*f*.

In a subsequent step SP12, the print controller 21 feeds (carries) the recording medium P by a predetermined amount. In a subsequent step SP13, the print controller 21 sequentially prints the eight overlapping patterns 111*fb* that form the adjustment pattern Pt4 (Adjt. Pattern in FIG. 12A) while repeatedly performing printing on the recording medium P and performing feeding of the recording medium P, and uses the detector 7 to sequentially detect the densities of the eight overlapping patterns 111*fb*. In this case, in the detector 7, the densities of the overlapping patterns 111*fb* are each detected multiple times. In the print controller 21, an average value of the multiple densities detected for each overlapping pattern 111*fb* is stored in the RAM 23 as a density value for the each overlapping pattern 111*fb*.

In a subsequent step SP14, the print controller 21 reads out the density values of the basic patterns 111*f* and the density values of the overlapping patterns 111*fb*, which are stored in the RAM 23, and, based on these density values, uses the correction amount calculator 21A to perform calculation, and thereby, determines a correction value for correcting the medium carrying amount. A calculation method for this case will be described later.

In a subsequent step SP15, the print controller 21 sets the correction value determined in the step SP14 to the carrying controller 29. As a result, using the correction value, the carrying controller 29 can correct the medium carrying amount by controlling the driving of the drive motor 30.

In a subsequent step SP16, the print controller 21 feeds the recording medium P, and sets an unused recording medium P on the platen 5. In a subsequent step SP17, in a state in which the medium carrying amount has been corrected using the correction value, the print controller 21 prints the test pattern 110 and the correction value on the recording medium P. Here, it is also possible that a user looks at the printed test pattern 110 and the correction value and determines that the correction value needs to be corrected, and inputs a new correction value to the inkjet printer 1 via the operation display part 24. In this case, the print controller 21 sets the input correction value as a final correction value to the carrying controller 29. The outline of the operation for correcting the medium carrying amount is as described above.

Figure 11:
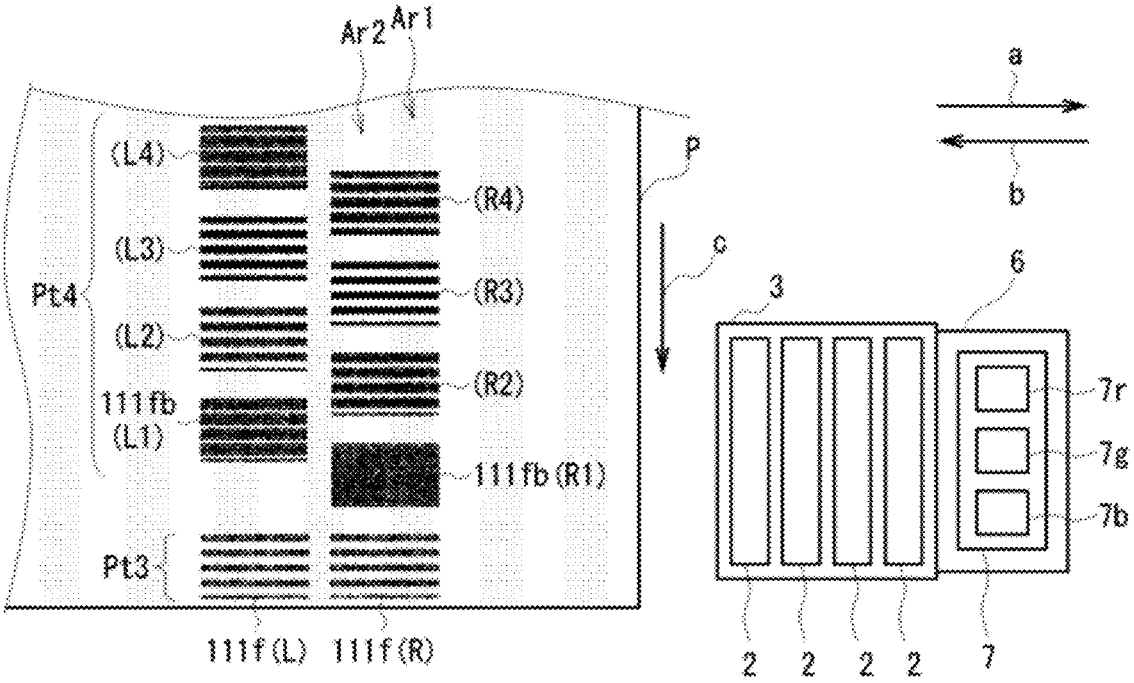
FIG. 11 illustrates a positional relationship between the first patterns and second patterns formed in the recording medium and a reference pattern and an adjustment pattern printed on the recording medium for correcting the medium carrying amount according to the first embodiment.
Figure 12A:
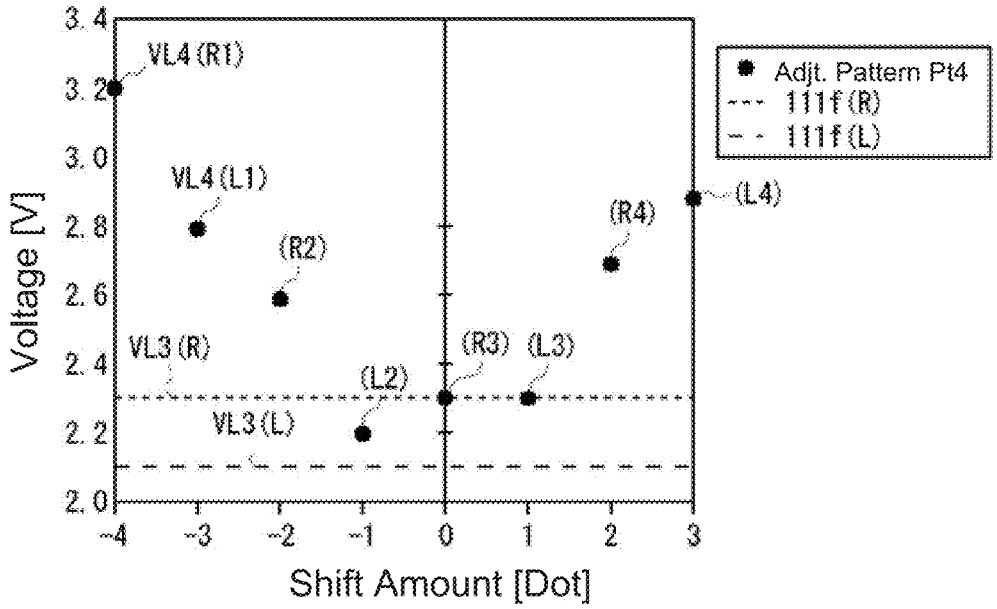
FIGS. 12A and 12B are graphs illustrating voltage values detected from the reference pattern and the adjustment pattern for correcting the medium carrying amount according to the first embodiment, and differences in voltage values between the adjustment pattern and the reference pattern.
Figure 12B:
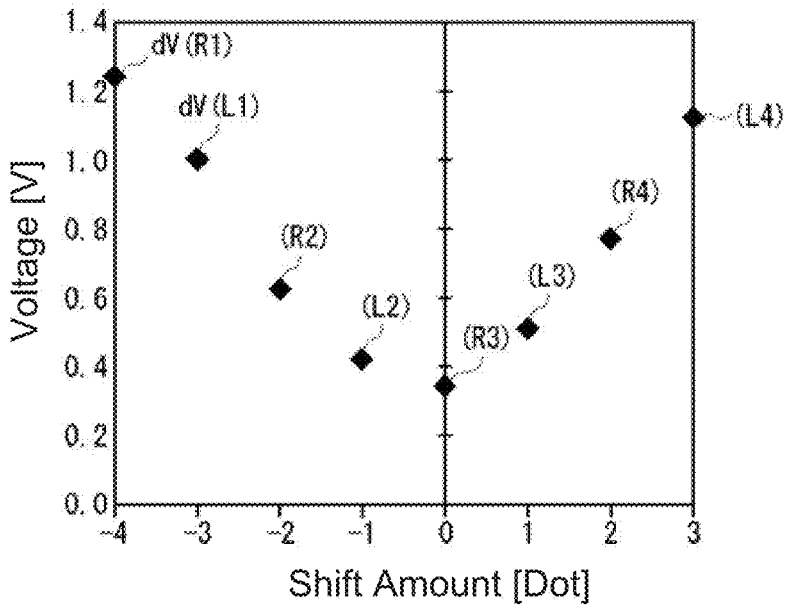

Next, the method for the calculation of the correction value performed in the above-described step SP15 is described using FIGS. 11, 12A and 12B.

FIG. 11 illustrates a positional relationship between the first patterns Ar1 and second patterns Ar2 formed in the recording medium P and the reference pattern Pt3 and adjustment pattern Pt4 printed as the test pattern 110 on the recording medium P. The reference pattern Pt3 is formed of two basic patterns 111*f* (L), 111*f* (R) arranged in the main scanning direction.

The adjustment pattern Pt4 is formed of eight overlapping patterns 111*fb* arranged in a staggered pattern in the medium carrying direction. The eight overlapping patterns 111*fb* include the overlapping patterns 111*fb* (L1)-111*fb* (L4) sequentially arranged from the lower side of the left column in the figure and the overlapping patterns 111*fb* (R1)-111*fb* (R4) sequentially arranged from the lower side of the right column in the figure. In FIG. 11, the reference numeral symbols of the overlapping patterns 111*fb* (L2)-111*fb* (L4) are abbreviated to (L2)-(L4). Similarly, the reference numeral symbols of the overlapping patterns 111*fb* (R2)-111*fb* (R4) are abbreviated to (R2)-(R4).

The basic pattern 111*f* (L) of the reference pattern Pt3 corresponds to the overlapping patterns 111*fb* (L1)-111*fb* (L4) of the adjustment pattern Pt4, and the basic pattern 111*f* (R) of the reference pattern Pt3 corresponds to the overlapping patterns 111*fb* (R1)-111*fb* (R4) of the adjustment pattern Pt4.

The corresponding basic pattern 111*f* (L) and overlapping patterns 111*fb* (L1)-111*fb* (L4) are printed at positions where they have the same positional relationship (overlapping state) with respect to the first patterns Ar1 and second patterns Ar2 formed in the recording medium P. Specifically, the corresponding basic pattern 111*f* (L) and overlapping patterns 111*fb* (L1)-111*fb* (L4) are printed such that they are lined up in the medium carrying direction with their positions in the main scanning direction aligned with each other. As a result, the corresponding basic pattern 111*f* (L) and overlapping patterns 111*fb* (L1)-111*fb* (L4) have the same positional relationship (overlapping state) with respect to the first patterns Ar1 and second patterns Ar2.

In this way, the corresponding basic pattern 111*f* (L) and overlapping patterns 111*fb* (L1)-111*fb* (L4) are printed at positions where their positional relationships (overlapping states) with respect to the first patterns Ar1 and second patterns Ar2 are the same, and thus, the corresponding basic pattern 111*f* (L) and overlapping patterns 111*fb* (L1)-111*fb* (L4) are printed at positions where the light reflection characteristics are substantially the same.

Similarly, the corresponding basic pattern 111*f* (R) and overlapping patterns 111*fb* (R1)-111*fb* (R4) are also printed such that they are arranged in the medium carrying direction with their positions in the main scanning direction aligned with each other, and their positional relationships (overlapping states) with respect to the first patterns Ar1 and second patterns Ar2 are the same. The positional relationship between the first patterns Ar1 and second patterns Ar2 and the reference pattern Pt3 and adjustment pattern Pt4 is as described above.

Next, a graph of FIG. 12A illustrates an example of the voltage values VL3 (L), VL3 (R) as density values obtained by detecting with the detector 7 the densities of the basic patterns 111*f* (L), 111*f* (R) forming the reference pattern Pt3 printed on the recording medium P, the voltage values VL4 (L1)-VL4 (L4) as density values obtained by detecting with the detector 7 the densities of the overlapping patterns 111*fb* (L1)-111*fb* (L4) forming the adjustment pattern Pt4, and the voltage values VL4 (R1)-VL4 (R4) as density values obtained by detecting with the detector 7 the densities of the overlapping patterns 111*fb* (R1)-111*fb* (R4).

FIG. 12A is a graph in which a vertical axis represents voltages and a horizontal axis represents the shift amounts set to the overlapping patterns 111*fb* (L1)-111*fb* (L4), 111*fb* (R1)-111*fb* (R4), and, on the graph, the voltage values VL3 (L), VL3 (R), the voltage values VL4 (L1)-VL4 (L4), and the voltage values VL4 (R1)-VL4 (R4) are plotted. On the graph, the reference numeral symbols of the voltage values VL4 (L2)-VL4 (L4) are abbreviated to (L2)-(L4). Similarly, the reference numeral symbols of the voltage values VL4 (R2)-VL4 (R4) are abbreviated to (R2)-(R4).

As can be seen from this graph, for the voltage values VL4 (L1)-VL4 (L4), VL4 (R1)-VL (R4) obtained from the adjustment pattern Pt4, the voltage value VL4 (L2) detected from the overlapping pattern 111*fb* (L2) having a shift amount of −1 is the lowest.

However, the voltage values VL4 (L1)-VL4 (L4), VL4 (R1)-VL (R4) are affected by the first patterns Ar1 and second patterns Ar2 formed in the recording medium P, and thus, do not necessarily represent accurate densities.

Therefore, in the present embodiment, by taking differences of the voltage values VL4 (L1)-VL4 (L4) detected from the overlapping patterns 111*fb* (L1)-111*fb* (L4) of the adjustment pattern Pt4 relative to the voltage value VL3 (L) detected from the basic pattern 111*f* (L) of the reference pattern Pt3 and taking differences of the voltage values VL4 (R1)-VL4 (R4) detected from the overlapping patterns 111*fb* (R1)-111*fb* (R4) of the adjustment pattern Pt4 relative to the voltage value VL3 (R) detected from the basic pattern 111*f* (R) of the reference pattern Pt3, the accurate densities of the overlapping patterns 111*fb* can be detected.

As described above, the corresponding overlapping patterns 111*fb* (L1)-111*fb* (L4) and basic pattern 111*f* (L), which are printed as the test pattern 110, have the same positional relationship with respect to the first patterns Ar1 and second patterns Ar2 formed in the recording medium P. Therefore, by taking the differences of the voltage values VL4 (L1)-VL4 (L4) detected from the overlapping patterns 111*fb* (L1)-111*fb* (L4) of the adjustment pattern Pt4 relative to the voltage value VL3 (L) detected from the basic pattern 111*f* (L) of the reference pattern Pt3, the influence of the first patterns Ar1 and the second patterns Ar2 can be eliminated from the voltage values VL4 (L1)-VL4 (L4), and the accurate densities can be obtained.

Further, the corresponding overlapping patterns 111*fb* (R1)-111*fb* (R4) and basic pattern 111*f* (R) also have the same positional relationship with respect to the first patterns Ar1 and the second patterns Ar2. Therefore, by taking the differences of the voltage values VL4 (R1)-VL4 (R4) detected from the overlapping patterns 111*fb* (R1)-111*fb* (R4) of the adjustment pattern Pt4 relative to the voltage value VL3 (R) detected from the basic pattern 111*f* (R) of the reference pattern Pt3, the influence of the first patterns Ar1 and the second patterns Ar2 can be eliminated from the voltage values VL4 (R1)-VL4 (R4), and the accurate densities can be obtained.

Here, differences dV (L1)-dV (L4) which are the differences of the voltage values VL4 (L1)-VL4 (L4) relative to the voltage value VL3 (L) and differences dV (R1)-dV (R4) which are the differences of the voltage values VL4 (R1)-VL4 (R4) relative to the voltage value VL3 (R) are shown on a graph of FIG. 12B. On this graph, the reference numeral symbols of the differences dV (L2)-dV (L4) are abbreviated to (L2)-(L4). Similarly, the reference numeral symbols of the differences dV (R2)-dV (R4) are abbreviated to (R2)-(R4).

As can be seen from this graph, for the differences dV (L1)-(L4), dV (R1)-dV (R4), the difference dV (R3) between the voltage value VL4 (R3) and the voltage value VL3 (R) is the lowest. That is, when it is determined based on the differences dV (L1)-(L4), dV (R1)-dV (R4), since the density of the overlapping pattern 111*fb* (R3) having a shift amount of 0 is the lowest, the accurate shift amount of the medium carrying amount in this case is 0. Using such a calculation method, the print controller 21 detects an accurate shift amount of the medium carrying amount, and, based on this shift amount, determines a correction value for the medium carrying amount.

Thus, in the inkjet printer 1 of the present embodiment, using the recording medium P in which the first patterns Ar1 and the second patterns Ar2 having different reflection characteristics are formed, the landing positions of the dots of the outbound path and the inbound path can be appropriately corrected and the medium carrying amount can be appropriately corrected.

In the present embodiment, the landing positions of the dots of the outbound path and the inbound path and the medium carrying amount are corrected using the recording medium P having multiple regions (the first patterns Ar1 and the second patterns Ar2) having different reflection characteristics. However, even when a recording medium having uniform reflection characteristics is used, the landing positions of the dots of the outbound path and the inbound path and the medium carrying amount can be corrected using the same method.

1-7. Structure of Recording Medium

Figure 13:
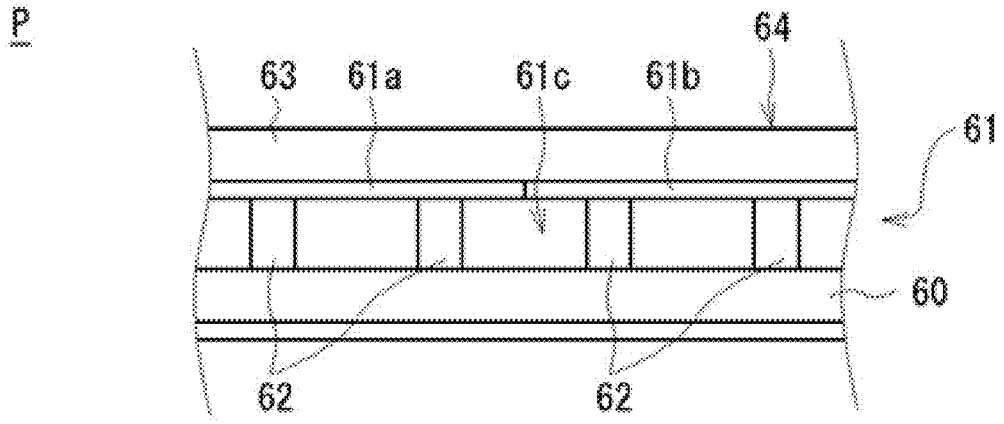
FIG. 13 is a cross-sectional view illustrating a structure of a recording medium having retro-reflection characteristics according to the first embodiment.

Next, an example of a structure of the recording medium P is described using FIG. 13. Here, as an example, a structure of a recording medium P having retroreflection characteristics is described. FIG. 13 is a cross-sectional view of a deformed structure of the recording medium P. As illustrated in FIG. 13, the recording medium P having retroreflection characteristics has a base layer 60, a reflection layer 61, support layers 62, and a film layer 63.

The recording medium P has a structure in which the reflection layer 61 is sandwiched between the base layer 60 and the film layer 63. The reflection layer 61 has first prism layers 61*a* and second prism layers 61*b*, which are provided so as to be arranged along a surface 64 of the recording medium P on a side close to the film layer 63, and an air layer 61*c*, which is provided between these first prism layers 61*a* and second prism layers 61*b* and the base layer 60. Further, on the base layer 60, in order for a thickness of the air layer 61*c*, or thicknesses of the first prism layers 61*a* and the second prism layers 61*b*, to be constant, the multiple support layers 62 are each provided in a projecting manner and are arranged at intervals in directions along the surface 64.

In the recording medium P, when light transmitted through the film layer 63 is incident on the reflection layer 61, the reflection layer 61 reflects the light (incident light) in a direction substantially opposite to an incident direction. Here, of the reflection layer 61, the first prism layers 61*a* and the second prism layers 61*b* have different reflection characteristics. Specifically, the first prism layers 61*a* and the second prism layers 61*b* have different reflection angles when reflecting light.

Then, in the recording medium P, when the first prism layers 61*a* and the second prism layers 61*b* are alternately arranged in the main scanning direction, portions corresponding to the first prism layers 61*a* become portions corresponding to the first patterns Ar1 illustrated in FIG. 2, and portions corresponding to the second prism layers 61*b* become portions corresponding to the second patterns Ar2.

In this way, in the recording medium P having retroreflection characteristics, due to the structure of the reflection layer 61, the first patterns Ar1 and the second patterns Ar2 having different light reflection characteristics are formed. That is, in the inkjet printer 1 of the present embodiment, even when such a recording medium P having retroreflection characteristics is used, the shift amount of the landing positions of the dots of the outbound path and the inbound path and the shift amount of the medium carrying amount can be accurately detected using the above method, and, based on these shift amounts, the landing positions of the dots of the outbound path and the inbound path and the medium carrying amount can be appropriately corrected.

1-8. Summary and Effect

As described above, when correcting the landing positions of the dots of the outbound path and the inbound path, the inkjet printer 1 of the first embodiment prints the test pattern 100 on the recording medium P and detects with the detector 7 the test pattern 100, and, based on the detection results of the detector 7, obtains a correction value, and uses the obtained correction value to correct the landing positions of the dots of the outbound path and the inbound path.

Further, in the first embodiment, the test pattern 100 includes the reference pattern Pt1 and the adjustment pattern Pt2. The adjustment pattern Pt2 includes eight overlapping patterns 101*fb* that each include a basic pattern 101*f* printed in the outbound path and a basic pattern 101*b* overlappingly printed on the basic pattern 101*f* in the inbound path. The two basic patterns 101*f*, 101*b* of each of the eight overlapping patterns 101*fb* have different shift amounts in the main scanning direction (that is, a relative movement direction of the recording medium P and the inkjet type recording heads 2 when the inkjet type recording heads 2 move back and forth to perform printing). On the other hand, the reference pattern Pt1 has eight basic patterns 101*f* respectively corresponding to the eight overlapping patterns 101*fb*.

Then, based on the detection results (that is, densities) obtained by detecting with the detector 7 the eight overlapping patterns 101*fb* forming the adjustment pattern Pt2 and the detection results (densities) obtained by detecting with the detector 7 the eight basic patterns 101*f* forming the reference pattern Pt1, the inkjet printer 1 obtains a correction value of the landing positions of the dots of the outbound path and the inbound path, and, based on the correction value, corrects the landing positions of the dots of the outbound path and the inbound path. The detection results described first may be referred as adjustment detection results. The detection results described next may be referred as a reference detection result.

As a result, the inkjet printer 1 can appropriately correct the landing positions of the dots of the outbound path and the inbound path by simply setting the positional relationship between corresponding overlapping pattern 101*fb* and basic pattern 101*f* to a positional relationship in accordance with the first patterns Ar1 and the second patterns Ar2 of the recording medium P. Specifically, in the present embodiment, corresponding overlapping pattern 101*fb* and basic pattern 101*f* are printed at positions where the corresponding overlapping pattern 101*fb* and basic pattern 101*f* have the same positional relationship with respect to the first patterns Ar1 and the second patterns Ar2 in the recording medium P. By doing so, the inkjet printer 1 can appropriately correct the landing positions of the dots of the outbound path and the inbound path even when the recording medium P having the first patterns Ar1 and the second patterns Ar2 having different reflection characteristics is used.

Further, when correcting the medium carrying amount, the inkjet printer 1 of the first embodiment prints the test pattern 110 on the recording medium P and detects with the detector 7 the test pattern 110, and, based on the detection results of the detector 7, obtains a correction value, and uses the obtained correction value to correct the medium carrying amount.

Further, in the first embodiment, the test pattern 110 includes the reference pattern Pt3 and the adjustment pattern Pt4. The adjustment pattern Pt4 includes eight overlapping patterns 111*fb* that each include a basic pattern 111*f* printed before the medium is carried and a basic pattern 111*b* overlappingly printed on the basic pattern 111*f* after the medium is carried. The two basic patterns 111*f*, 111*b* of each of the eight overlapping patterns 111*fb* have different shift amounts in the medium carrying direction (that is, a relative movement direction of the recording medium P and the inkjet type recording heads 2 when the recording medium P is carried during printing). On the other hand, the reference pattern Pt3 has two basic patterns 111*f* provided at positions corresponding to the eight overlapping patterns 111*fb*.

Then, based on the detection results (densities) obtained by detecting with the detector 7 the eight overlapping patterns 111*fb* forming the adjustment pattern Pt4 and the detection results (densities) obtained by detecting with the detector 7 the two basic patterns 111*f* forming the reference pattern Pt3, the inkjet printer 1 obtains a correction value of the medium carrying amount, and, based on the correction value, corrects the medium carrying amount. In the embodiment, the detection results described first may be referred as adjustment detection results. The detection results described next may be referred as a reference detection result.

As a result, the inkjet printer 1 can appropriately correct the medium carrying amount by simply setting the positional relationship between corresponding overlapping patterns 111*fb* and basic pattern 111*f* to a positional relationship in accordance with the first patterns Ar1 and the second patterns Ar2 of the recording medium P. Specifically, in the present embodiment, corresponding overlapping patterns 111*fb* and basic pattern 111*f* are printed at positions where the corresponding overlapping patterns 111*fb* and basic pattern 111*f* have the same positional relationship with respect to the first patterns Ar1 and the second patterns Ar2 in the recording medium P. By doing so, the inkjet printer 1 can appropriately correct the medium carrying amount even when the recording medium P having the first patterns Ar1 and the second patterns Ar2 having different reflection characteristics is used.

Thus, in the inkjet printer 1 of the present embodiment, even when the recording medium P having multiple regions (the first patterns Ar1 and the second patterns Ar2) having different reflection characteristics is used, the recording positions of the dots (the landing positions of the dots of the outbound path and the inbound path and the medium carrying amount) can be appropriately corrected.

2. Second Embodiment

Next, a second embodiment is described. In the above-described first embodiment, as illustrated in FIG. 2, the first patterns Ar1 and the second patterns Ar2 formed in the recording medium P extend along the medium carrying direction indicated by the arrow c. However, it is also possible that these first patterns Ar1 and second patterns Ar2 are inclined with respect to medium carrying direction. Therefore, in the second embodiment, even when a recording medium P in which the first patterns Ar1 and the second patterns Ar2 are inclined with respect to the medium carrying direction is used, the recording positions of the dots can be appropriately corrected.

The configuration of the inkjet printer 1 (or recording apparatus) is the same as that in the first embodiment, and a detailed description thereof is omitted. Therefore, in the following, only a method for correcting the recording positions of the dots is described.

2-1. Correction of Recording Positions of Dots by Inkjet Printer

Figure 14:
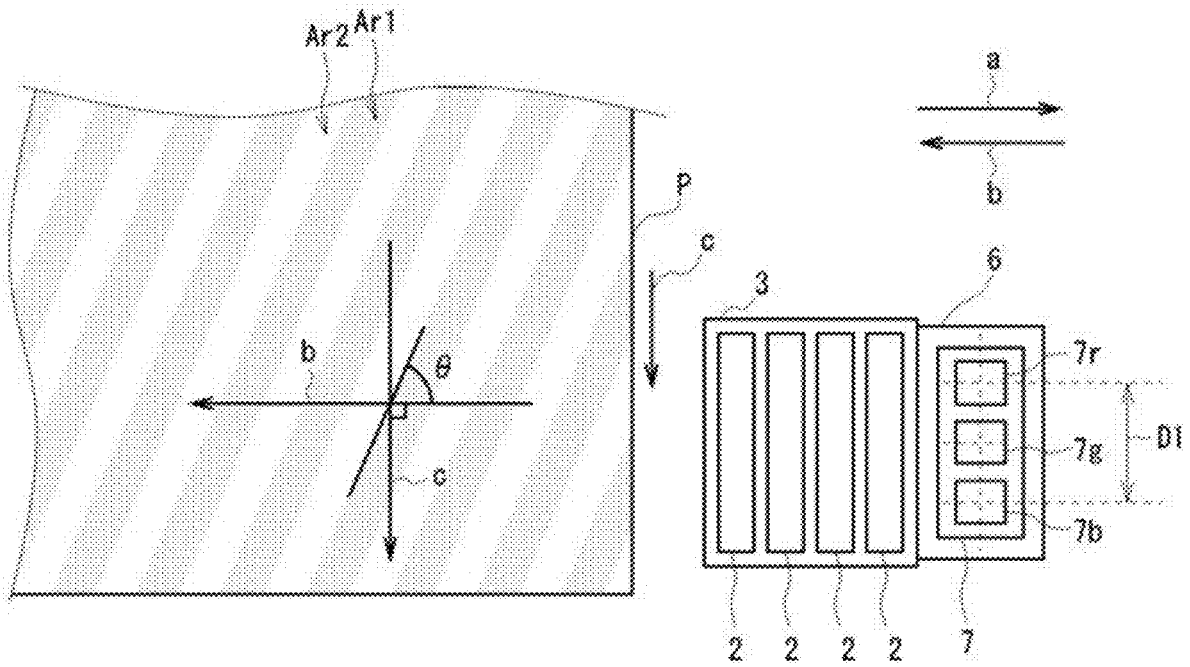
FIG. 14 is a top view of a sensor unit and a recording medium according to a second embodiment.

Next, configurations of the sensor unit 6 and the recording medium P are described in detail using FIG. 14. FIG. 14 is a top view of the sensor unit 6 and the recording medium P. The sensor unit 6 has the same configuration as in the first embodiment. Here, a distance in the medium carrying direction indicated by the arrow c between the R detector 7*r* positioned at one end in the medium carrying direction and the B detector 7*b* positioned at the other end is defined as a distance D1.

On the other hand, in the recording medium P, the first patterns Ar1 and the second patterns Ar2 are inclined with respect to the medium carrying direction indicated by the arrow c, and each form an angle θ with respect to the main scanning direction indicated by the arrow b. The configurations of the sensor unit 6 and the recording medium P are as described above.

Next, a method for calculating the angle θ formed by each of the first patterns Ar1 and the second patterns Ar2 with respect to the main scanning direction is described. The calculation of the angle θ is performed by the print controller 21. The print controller 21 detects the first patterns Ar1 and the second pattern Ar2 in the recording medium P by operating the R detector 7*r* and the B detector 7*b* on the recording medium P while moving the carriage 3 in the main scanning direction indicated by the arrow b. The print controller 21 performs the detection of the first patterns Ar1 and the second patterns Ar2 from one end to the other end of the recording medium P in the main scanning direction, that is, over the entire width of the recording medium P in the main scanning direction.

Figure 15:
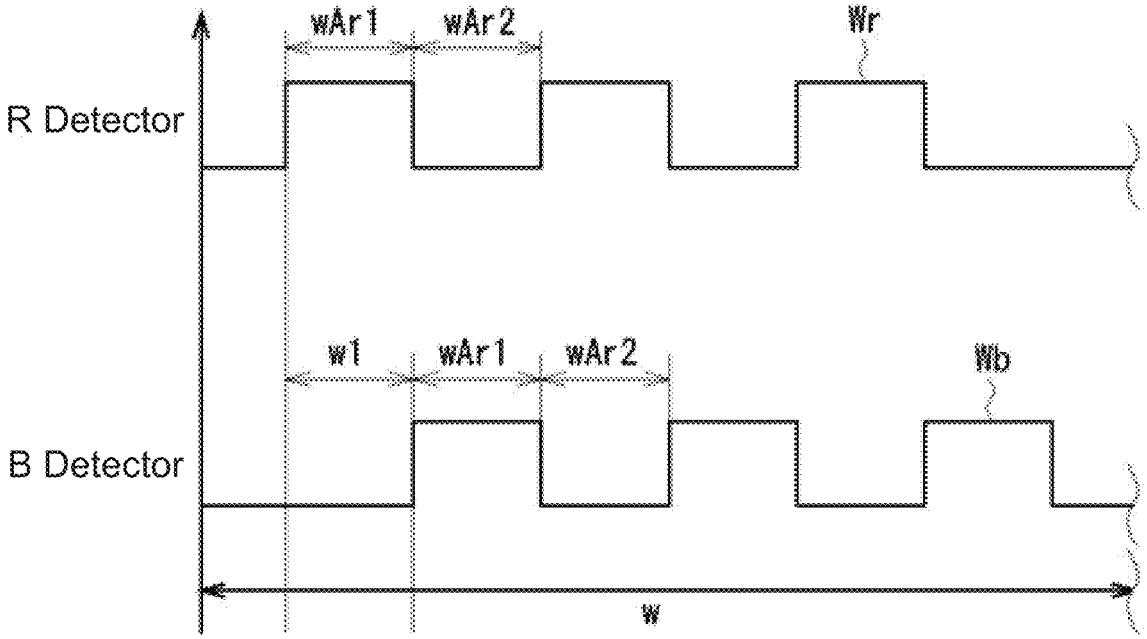
FIG. 15 illustrates waveforms illustrating detection results when first patterns and second patterns according to the second embodiment are detected with an R detector and a B detector.

Here, FIG. 15 illustrates detection values detected by the R detector 7*r* and detection values detected by the B detector 7*b* when the detection of the first patterns Ar1 and the second patterns Ar2 is performed over the entire width of the recording medium P in the main scanning direction. In FIG. 15, the detection values detected by the R detector 7*r* and the detection values detected by the B detector 7*b* are respectively illustrated as waveforms Wr, Wb. For the waveforms Wr, Wb, a vertical direction in the figure represents the detection values and a horizontal direction in the figure represents detection positions on the recording medium P. Further, in FIG. 15, "w" indicates the width of the recording medium P, "wAr1" indicates a detection width of each of the first patterns Ar1, "wAr2" indicates a detection width of each of the second patterns Ar2, and "w1" indicates a shift width between the waveform Wr and the waveform Wb.

That is, from the waveforms Wr, Wb, it can be seen that, when the R detector 7*r* detects a first pattern Ar1, the B detector 7*b* has not yet detected this first pattern Ar1, and, after that, when the carriage 3 advances by w1, the B detector 7*b* detects the first pattern Ar1 detected earlier by the R detector 7*r*.

Therefore, the angle θ formed by each of the first patterns Ar1 and second patterns Ar2 with respect to the main scanning direction can be determined from the following formula (2) using the shift width w1 between the waveform Wr and the waveform Wb and the distance D1 between the R detector 7*r* and the B detector 7*b*.

$$\theta=\arctan(D1/w1),\ -\pi/2\leq\theta\leq\pi/2 \quad (2)$$

The method for calculating the angle θ formed by each of the first patterns Ar1 and the second patterns Ar2 with respect to the main scanning direction is as described above. In the present embodiment, the angle θ is determined using the R detector 7*r* and the B detector 7*b* of the detector 7. However, without being limited to this, it is also possible that the angle θ is determined using two or more detectors among the R detector 7*r*, the G detector 7*g* and the B detector 7*b* of the detector 7 by making an approximation such as using a least-square method.

Based on the angle θ calculated in this way, the print controller 21 modifies the arrangement of the reference pattern Pt1 and the adjustment pattern Pt2 in the test pattern 100 used for correcting the landing positions of the dots of the outbound path and the inbound path, and modifies the arrangement of the reference pattern Pt3 and the adjustment pattern Pt4 in the test pattern 110 used for correcting the medium carrying amount.

Figure 16A:
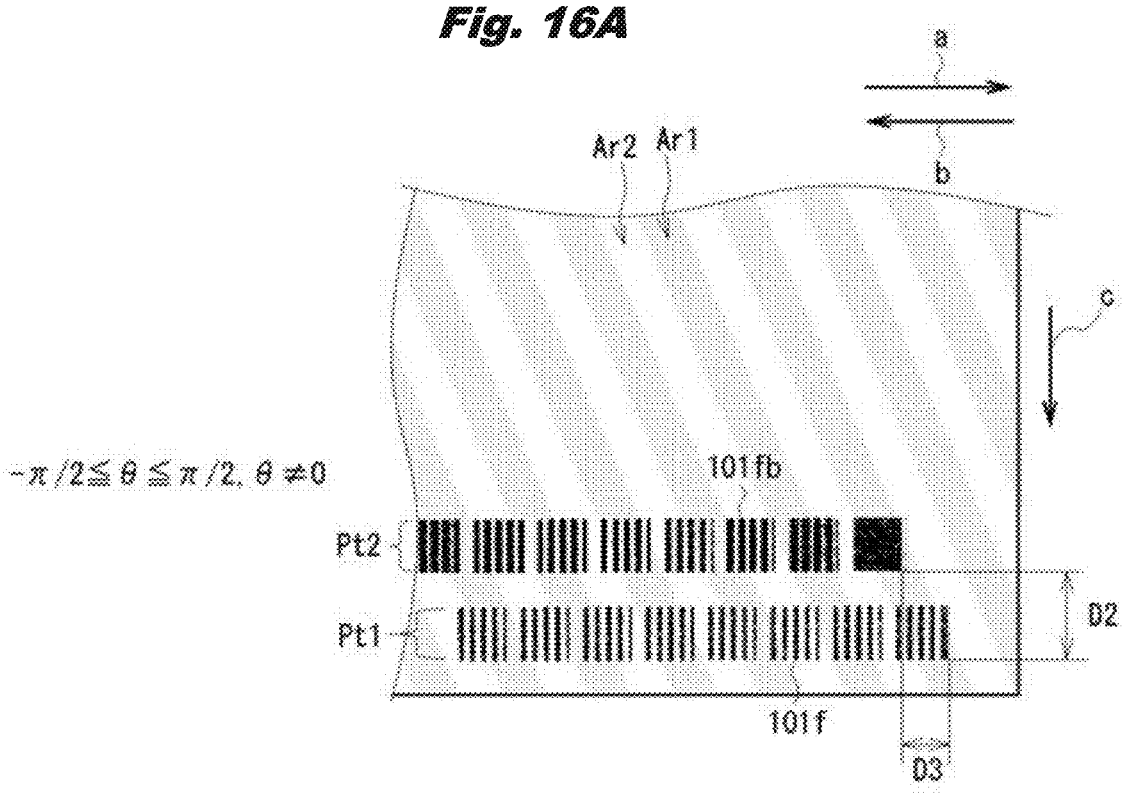
FIGS. 16A and 16B are diagrams illustrating arrangement examples of a reference pattern and an adjustment pattern for correcting the landing positions of the dots of the outbound path and the inbound path according to the second embodiment.
Figure 16B:
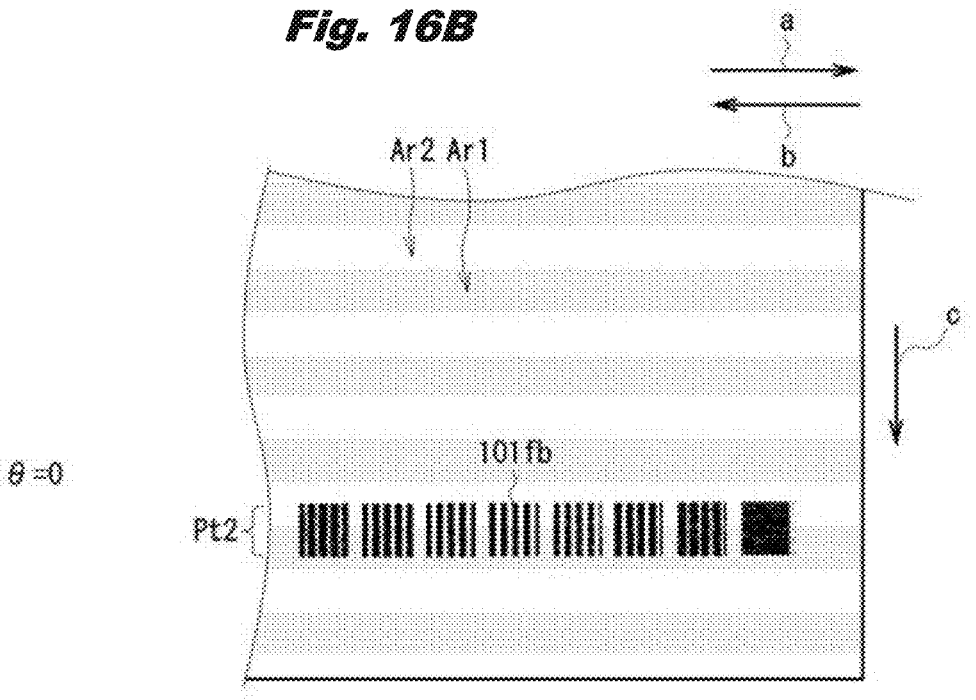

Here, a method for modifying the arrangement of the reference pattern Pt1 and the adjustment pattern Pt2 is described. FIGS. 16A and 16B illustrate arrangement examples of the reference pattern Pt1 and the adjustment pattern Pt2.

FIG. 16A illustrates an arrangement example of a case where $-\pi/2\leq\theta\leq\pi/2$ and $\theta\neq0$. In this case, when a distance between the reference pattern Pt1 and the adjustment pattern Pt2 in the medium carrying direction is set to D2, a shift amount D3 of the adjustment pattern Pt2 in the main scanning direction with respect to the reference pattern Pt1 can be determined from the following formula (3).

$$D3=D2/\tan\theta=D2\times w1/D1 \quad (3)$$

The distance D2 is a distance from one end of the reference pattern Pt1 in the medium carrying direction to one end of the adjustment pattern Pt2 in the medium carrying direction.

That is, when $-\pi/2\leq\theta\leq\pi/2$ and $\theta\neq0$, the print controller 21 prints the adjustment pattern Pt2 at a position shifted by the shift amount D3 in the main scanning direction with respect to the reference pattern Pt1.

By doing so, when the angle θ is in the range of $-\pi/2\leq\theta\leq\pi/2$ and $\theta\neq0$, the print controller 21 can print corresponding basic pattern 101*f* and overlapping pattern 101*fb* at positions where the corresponding basic pattern 101*f* and overlapping pattern 101*fb* have the same positional relationship with respect to the first patterns Ar1 and second patterns Ar2 formed in the recording medium P.

On the other hand, FIG. 16B illustrates an arrangement example of a case where θ=0. In this case, the eight overlapping patterns 101*fb* forming the adjustment pattern Pt2 all have the same position with respect to the first patterns Ar1 and the second patterns Ar2. Therefore, in this case, the reference pattern Pt1 is not required. That is, when θ=0, the print controller 21 prints only the adjustment pattern Pt2.

In this case, the print controller 21 determines a correction value for the landing positions of the dots of the outbound path and the inbound path using only density values detected from the eight overlapping patterns 101*fb* forming the adjustment pattern Pt2. The method of modifying the arrangement of the reference pattern Pt1 and the adjustment pattern Pt2 is as described above.

Figure 17A:
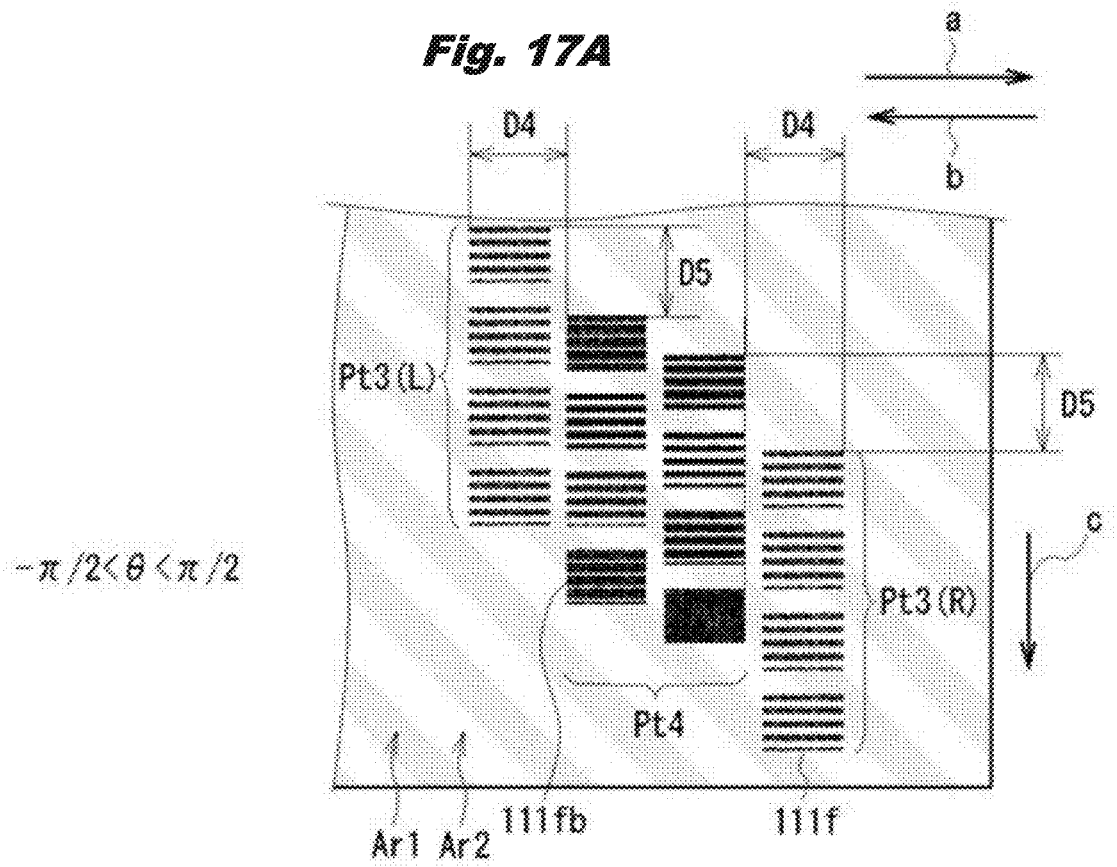
FIGS. 17A and 17B are diagrams illustrating arrangement examples of a reference pattern and an adjustment pattern for correcting the medium carrying amount according to the second embodiment.
Figure 17B:
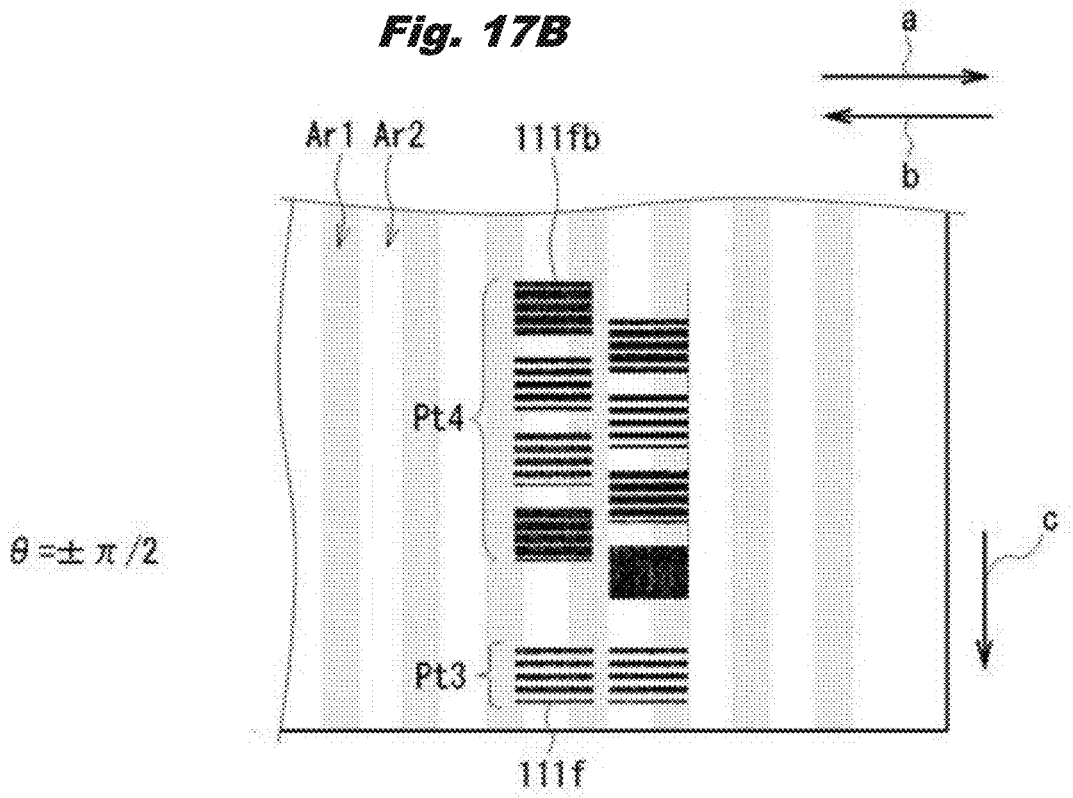

Next, a method of modifying the arrangement of the reference pattern Pt3 and the adjustment pattern Pt4 is described. FIGS. 17A and 17B illustrate arrangement examples of the reference pattern Pt3 and the adjustment pattern Pt4.

FIG. 17A illustrates an arrangement example of a case where $-\pi/2<\theta<\pi/2$. In this case, the reference pattern Pt3 is formed by the same number of (that is, 8) basic patterns 111*f* as that of the eight overlapping patterns 111*fb* forming the adjustment pattern Pt4. Specifically, reference patterns Pt3 (L), Pt3 (R) that each include 4 basic patterns 111*f* arranged in the medium carrying direction are respectively arranged on both outer sides of the adjustment pattern Pt4 in the main scanning direction (the left-right direction in the figure indicated by the arrows a and b).

The 4 basic patterns 111*f* forming the reference pattern Pt3 (L) respectively correspond to 4 overlapping patterns 111*fb* forming one column (a left column in the figure) of the adjustment pattern Pt4 which includes 2 columns in the main scanning direction. Further, the 4 basic patterns 111*f* forming the reference pattern Pt3 (R) respectively correspond to 4 overlapping patterns 111*fb* forming the other column (the right column in the figure) of the adjustment pattern Pt4.

In this case, when a distance in the main scanning direction between the right column of the adjustment pattern Pt4 and the reference pattern Pt3 (R) is set to D4, a shift amount D5 of the reference pattern Pt3 (R) in the medium carrying direction (a downward direction in the figure indicated by the arrow c) with respect to the right column of the adjustment pattern Pt4 can be determined from the following formula (4).

$$D5=D4/\tan\theta=D4\times w1/D1 \quad (4)$$

The distance D4 is a distance from one end of the right column of the adjustment pattern Pt4 in the main scanning direction to one end of the reference pattern Pt3 (R) in the main scanning direction.

That is, when $-\pi/2<\theta<\pi/2$, the print controller 21 prints the reference pattern Pt3 (R) at a position shifted by the shift amount D5 in the medium carrying direction indicated by the arrow c with respect to the right column of the adjustment pattern Pt4.

Further, in this case, the print controller 21 prints the reference pattern Pt3 (L) at a position shifted by the shift amount D5 in a direction opposite to the medium carrying direction indicated by the arrow c with respect to the left column of adjustment pattern Pt4.

By doing so, when the angle θ is in the range of $-\pi/2<\theta<\pi/2$ and $\theta\neq0$, the print controller 21 can print corresponding basic pattern 111*f* and overlapping pattern 111*fb* at positions where the corresponding basic pattern 111*f* and overlapping pattern 111*fb* have the same positional relationship with respect to the first patterns Ar1 and second patterns Ar2 formed in the recording medium P.

On the other hand, FIG. 17B illustrates an arrangement example of a case where $\theta=\pm\pi/2$. The arrangement example in this case is the same arrangement as the arrangement in the first embodiment illustrated in FIG. 11, and thus, a detailed description thereof is omitted. The method of modifying the arrangement of the reference pattern Pt3 and the adjustment pattern Pt4 is as described above.

Figure 18:
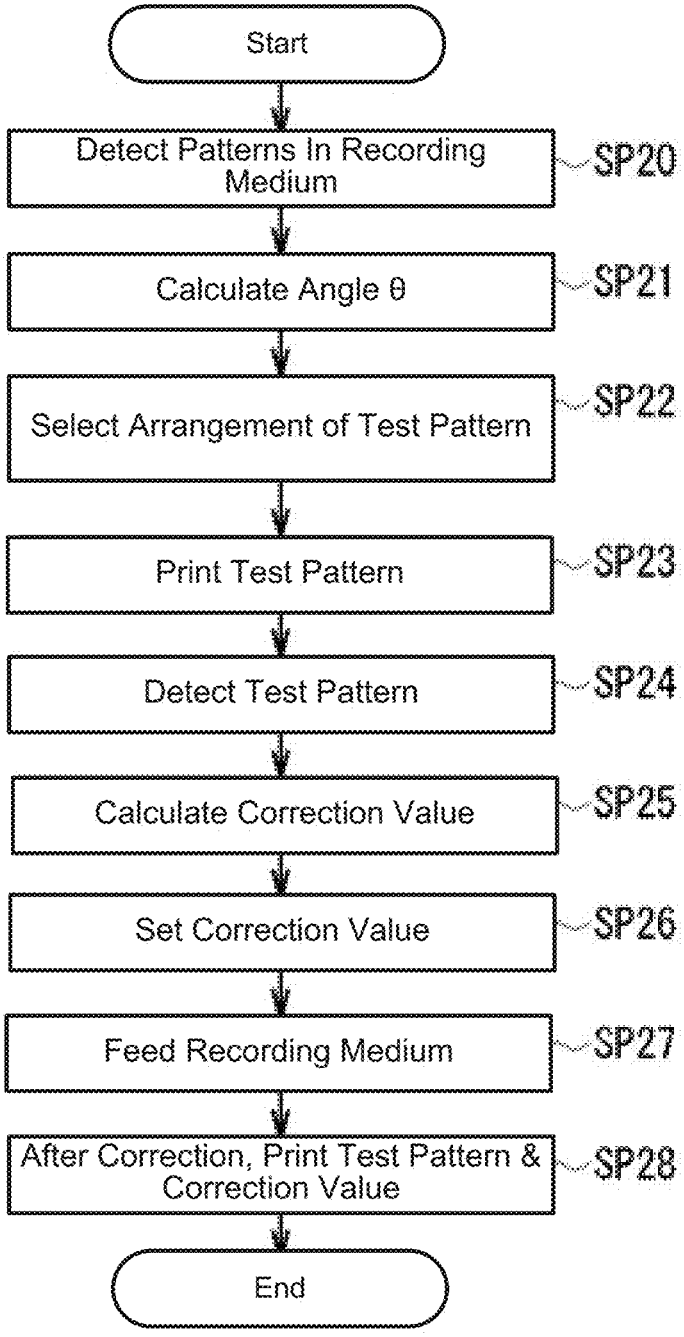
FIG. 18 is a flow diagram illustrating an operation procedure for correcting the recording positions of the dots according to the second embodiment.

Next, an outline of an operation for correcting the recording positions of the dots (the landing positions of the dots of the outbound path and the inbound path and the medium carrying amount) is described using a flow diagram illustrated in FIG. 18. This operation is mainly performed by the print controller 21.

In a step SP20, the print controller 21 detects the first patterns Ar1 and the second pattern Ar2 in the recording medium P using the R detector 7*r* and the B detector 7*b* of the detector 7. The print controller 21 stores the detection results obtained from the R detector 7*r* and the B detector 7*b* in the RAM 23.

In a subsequent step SP21, the print controller 21 reads out the detection results of the R detector 7*r* and the detection results of the B detector 7*b* stored in the RAM 23, and, based on these results, uses the correction amount calculator 21A to calculate the angle θ formed by each of the first patterns Ar1 and the second patterns Ar2 with respect to the main scanning direction using the above-described method.

In a subsequent step SP22, based on the angle θ obtained in the step SP21, the print controller 21 selects the arrangement of the test pattern (the test pattern 100 or the test pattern 110) using the above-described method.

In a subsequent step SP23, the print controller 21 prints the test pattern with the arrangement selected in the step SP22. In a subsequent step SP24, the print controller 21 detects the printed test pattern with the detector 7, and stores the detection results in the RAM 23.

In a subsequent step SP25, based on the detection results stored in the RAM 23, the print controller 21 determines a correction value by performing calculation using the correction amount calculator 21A. The method for determining the correction value is the same as in the first embodiment. In a subsequent step SP26, the print controller 21 sets the correction value determined in the step SP25.

In a subsequent step SP27, the print controller 21 feeds the recording medium P, and sets an unused recording medium P on the platen 5. In a subsequent step SP28, in a state in which the recording positions of the dots have been corrected using the correction value, the print controller 21 prints the test pattern and the correction value on the recording medium P. Here, it is also possible that a user looks at the printed test pattern and the correction value and determines that the correction value needs to be corrected, and inputs a new correction value to the inkjet printer 1 via the operation display part 24. In this case, the print controller 21 sets the input correction value as a final correction value. The operation for correcting the recording positions of the dots is as described above.

It is also possible that, in the steps SP22-SP26, the correction of the landing positions of the dots of the outbound path and the inbound path and the correction of the medium carrying amount are continuously performed.

2-2. Summary and Effect

As described above, the ink jet printer 1 of the second embodiment detects with the detector 7 the first patterns Ar1 and second patterns Ar2 that have different light reflection characteristics and are formed in the recording medium P, and, based on the detection results, calculates the angle θ formed by each of the first patterns Ar1 and the second patterns Ar2 with respect to the main scanning direction (that is, the movement direction of the carriage 3).

Further, based on the calculated angle θ, the inkjet printer 1 selects the arrangement of corresponding basic pattern (basic pattern 101*f* or basic pattern 111*f*) and overlapping pattern (overlapping pattern 101*fb* or overlapping pattern 111*fb*) such that the corresponding basic pattern (basic pattern 101*f* or basic pattern 111*f*) and overlapping pattern (overlapping pattern 101*fb* or overlapping pattern 111*fb*) have the same positional relationship with respect to the first patterns Ar1 and the second patterns Ar2.

As a result, regardless of the value of the angle θ formed by each of the first patterns Ar1 and the second patterns Ar2 with respect to the main scanning direction, the inkjet printer 1 can print the corresponding basic pattern (basic pattern 101*f* or basic pattern 111*f*) and overlapping pattern (overlapping pattern 101*fb* or overlapping pattern 111*fb*) at positions where the corresponding basic pattern (basic pattern 101*f* or basic pattern 111*f*) and overlapping pattern (overlapping pattern 101*fb* or overlapping pattern 111*fb*) have the same positional relationship with respect to the first patterns Ar1 and the second patterns Ar2.

By doing so, regardless of the value of the angle θ formed by each of the first patterns Ar1 and the second patterns Ar2 with respect to the main scanning direction, the inkjet printer 1 can detect, in the same way as in the first embodiment, accurate values as densities of the overlapping patterns (overlapping patterns 101*fb* or overlapping patterns 111*fb*) without being influenced by the first patterns Ar1 and the second patterns Ar2.

After that, based on the densities obtained by the detection with the detector 7, the inkjet printer 1 obtains a correction value of the recording positions of the dots (the landing positions of the dots of the outbound path and the inbound path or the medium carrying amount), and, based on the correction value, corrects the recording positions of the dots.

Thus, the inkjet printer 1 of the second embodiment can appropriately correct the recording positions of the dots regardless of the angle θ formed by each of the first patterns Ar1 and the second patterns Ar2 with respect to the main scanning direction.

3. Other Embodiments

3-1. First Other Embodiment

In the above-described first embodiment, the reference pattern Pt1 is printed once in the outbound path. However, without being limited to this, it is also possible to print twice in the outbound path such that a basic pattern 101*f* overlaps a basic pattern 101*f*. By doing so, the same ink amount is used for the reference pattern Pt1 and for the adjustment pattern Pt2, and the densities of the overlapping patterns 101*fb* forming the adjustment pattern Pt2 can be more accurately detected.

Similarly, in the second embodiment, it is also possible that the reference pattern Pt3 is printed twice in the outbound path such that a basic pattern 111*f* overlaps a basic pattern 111*f*.

3-2. Second Other Embodiment

Further, in the above-described first and second embodiments, even when a recording medium P in which multiple first patterns Ar1 and multiple second patterns Ar2 having different light reflection characteristics are alternately arranged (that is, periodically arranged) in a predetermined direction is used, the recording positions of the dots can be appropriately corrected.

Without being limited to this, for example, even when a recording medium in which multiple regions having different light reflection characteristics are formed so as to be arranged in a predetermined direction or a recording medium in which multiple regions having different light reflection characteristics are formed so as to be repeatedly arranged in a predetermined direction is used, the recording positions of the dots can be appropriately corrected using the same method as in the above-described first and second embodiments.

3-3. Third Other Embodiment

Further, in the above-described first embodiment, based on the detection results obtained by detecting with the detector 7 the test pattern 100 printed on the recording medium P, the print controller 21 detects a shift amount of the landing positions of the dots of the outbound path and the inbound path, and, based on this shift amount, determines a correction value.

Without being limited to this, for example, the following is also possible. First, a test pattern 100 that includes a reference pattern Pt1 and an adjustment pattern Pt2 having an overlapping pattern 101*fb* (or may be overlapping patterns 101*fb*) for which a shift amount is roughly set is printed, and, based on results obtained by detecting this test pattern 100 with the detector 7, an approximate shift amount of the recording positions of the dots is detected. Next, a test pattern 100 that includes a reference pattern Pt1 and an adjustment pattern Pt2 having an overlapping pattern 101*fb* for which a shift amount is more finely set in a range around the shift amount detected earlier is printed, and, based on results obtained by detecting the test pattern 100 with the detector 7, an accurate shift amount of the recording positions of the dots is detected, and, based on this shift amount, a correction value is determined. Similarly, in the second embodiment, the detection of the shift amount may be performed in two steps.

3-4. Fourth Other Embodiment

Further, in the above-described first embodiment, by taking the differences of the density values detected from the overlapping patterns 101*fb* forming the adjustment pattern Pt2 respectively relative to the density values detected from the basic patterns 101*f* forming the reference pattern Pt1, accurate values as the densities of the overlapping patterns 101*fb* can be detected without being influenced by the first patterns Ar1 and the second patterns Ar2.

Without being limited to this, for example, it is also possible that, by taking ratios of the density values detected from the overlapping patterns 101*fb* forming the adjustment pattern Pt2 respectively relative to the density values detected from the basic patterns 101*f* forming the reference pattern Pt1, accurate values as the densities of the overlapping patterns 101*fb* can be detected without being influenced by the first patterns Ar1 and the second patterns Ar2. Similarly, for the overlapping patterns 111*fb* of the adjustment pattern Pt4 and the basic patterns 111*f* of the reference pattern Pt3, it is also possible to take ratios, instead of differences, of the density values. The same also applies to the second embodiment.

3-5. Fifth Other Embodiment

Further, in the above-described first and second embodiments, the overlapping patterns 101*fb* of the adjustment pattern Pt2 are each formed of two basic patterns 101 (101*f*, 101*b*) and the reference pattern Pt1 is formed of the same basic patterns 101. Without being limited to this, for example, it is also possible that the reference pattern Pt1 is formed of predetermined patterns different from the basic patterns 101. Similarly, the reference pattern Pt3 may be formed of predetermined patterns different from the basic patterns 111. Further, the basic patterns 101, 111 themselves may be different from those in the first and second embodiments.

3-6. Sixth Other Embodiment

Further, in the above-described embodiments, the present invention is applied to the inkjet printer 1 having the inkjet type recording heads 2 for recording an image on a recording medium using ink as a recording agent. However, without being limited to this, the present invention can also be applied to a recording apparatus having a configuration different from that of the inkjet printer 1 as long as the recording apparatus has a recording head that records an image on a recording medium using a recording agent and the recording head records the image on the recording medium while moving back and forth in a main scanning direction orthogonal to a carrying direction of the recording medium. For example, the present invention can also be applied to recording apparatuses such as a dot printer, a thermal transfer printer, and a sublimation printer. Further, the present invention can also be applied to a recording apparatus for monochrome printing having one recording head or a recording apparatus for color printing having five or more recording heads (for example, 7 recording heads corresponding to 7 colors including light cyan, ride magenta and gray in addition to cyan, magenta, yellow and black). Further, the present invention can also be applied to a multifunction machine or the like equipped with such a recording apparatus.

3-7. Seventh Other Embodiment

Further, in the above-described embodiments, the carrying rollers 11 are provided as a specific example of a carrying part for carrying the recording medium in the inkjet printer 1 as a recording apparatus. However, without being limited to this, it is also possible that a carrying part different from the carrying rollers 11 is provided. Further, in the above-described embodiments, the print controller 21, the correction amount calculator 21A, the recording controller 28 and the carrying controller 29 are provided in the inkjet printer 1 as specific examples of controllers for obtaining a correction value based on the detection results of the test pattern and correcting the recording positions of the dots based on the correction value. However, without being limited to this, it is also possible that controllers different from the print controller 21, the correction amount calculator 21A, the recording controller 28 and the carrying controller 29 are provided. For example, the correction amount calculator 21A may be provided separately from the print controller 21.

3-8. Eighth Other Embodiment

Further, the present invention is not limited to the above-described embodiments. That is, the application scope of the present invention also covers embodiments obtained by arbitrarily combining a part or all of the above-described embodiments, and embodiments obtained by extracting a part of the above-described embodiments.

INDUSTRIAL APPLICABILITY

The present invention can be widely used in recording apparatuses such as an inkjet printer, a dot printer, a thermal transfer printer, and a sublimation printer.

What is claimed is:

1. A recording apparatus, comprising:

a recording head that records an image on a recording medium using a recording agent, the recording medium having multiple regions that have different light reflection characteristics;

a carrying part that carries the recording medium in a carrying direction of the recording medium;

a carriage on which the recording head is mounted and that reciprocates in a main scanning direction orthogonal to the carrying direction;

a detector that is mounted on the carriage and optically detects the image recorded on the recording medium; and a controller that obtains a correction value of recording positions of dots based on a detection result obtained by detecting with the detector a test pattern recorded on the recording medium by the recording head wherein the correction value is used when the image is recorded on the recording medium by the recording head, and, corrects the recording positions of the dots based on the correction value, wherein the test pattern includes an adjustment pattern and a reference pattern, the adjustment pattern includes multiple overlapping patterns that are each formed by overlapping two basic patterns, a shift amount of the two basic patterns in a relative movement direction of the recording medium and the recording head is different for each of the multiple overlapping patterns, the reference pattern is formed of predetermined patterns that each correspond to the multiple overlapping patterns, the correction value of recording positions of dots, which is obtained by the controller, is calculated based on adjustment detection results respectively obtained by detecting with the detector the multiple overlapping patterns forming the adjustment pattern and a reference detection result obtained by detecting with the detector the predetermined pattern forming the reference pattern, and the controller causes the recording head to record the corresponding overlapping patterns and predetermined pattern at positions of which the light reflection characteristics are substantially the same and corrects the recording positions of dots based on the correction value.

2. The recording apparatus according to claim 1, wherein the controller obtains the correction value of the recording positions of dots based on differences between detection values respectively obtained by detecting with the detector the multiple overlapping patterns forming the adjustment pattern, and a detection value obtained by detecting with the detector the predetermined pattern forming the reference pattern.

3. The recording apparatus according to claim 1, wherein the multiple regions of the recording medium each extend along a predetermined direction, and are arranged in a direction orthogonal to the predetermined direction.

4. The recording apparatus according to claim 3, wherein the multiple regions of the recording medium are sequentially and repeatedly arranged in the direction orthogonal to the predetermined direction.

5. The recording apparatus according to claim 3, wherein based on an angle formed by the predetermined direction in which the multiple regions each extend with respect to the main scanning direction, the controller determines an arrangement of the corresponding overlapping patterns and predetermined pattern.

6. The recording apparatus according to claim 1, wherein a shift amount of the two basic patterns in the main scanning direction is different for each of the multiple overlapping patterns, and the controller obtains the correction value of recording positions of dots when the image is recorded by reciprocating the carriage based on the adjustment detection results and the reference detection result, and, corrects the recording positions of dots based on the correction value.

7. The recording apparatus according to claim 1, wherein a shift amount of the two basic patterns in the carrying direction of the recording medium is different for each of the multiple overlapping patterns, and the controller obtains a correction value of the medium carrying amount indicating recording positions of dots when the image is recorded by carrying the recording medium based on the adjustment detection results and the reference detection result, and corrects a medium carrying amount based on the correction value.

8. The recording apparatus according to claim 1, wherein the recording medium has retro-reflection characteristics.

9. The recording apparatus according to claim 1, wherein the predetermined pattern forming the reference pattern is the same pattern as the basic pattern.

10. A correction method in a recording apparatus, the recording apparatus comprising:

a recording head that records an image on a recording medium using a recording agent, the recording medium having multiple regions that have different light reflection characteristics;

a carrying part that carries the recording medium in a carrying direction of the recording medium;

a carriage on which the recording head is mounted and that reciprocates in a main scanning direction orthogonal to the carrying direction;

a detector that is mounted on the carriage and optically detects the image recorded on the recording medium; and a controller that corrects recording positions of dots when the recording head records the image on the recording medium, the image being formed with the dots, the correction method, comprising:

a process in which the recording head records a test pattern on the recording medium;

a process in which the detector detects the test pattern recorded on the recording medium; and a process in which, based on a detection result obtained from the detector, the controller obtains a correction value of the recording positions of dots, and the controller corrects the recording positions of dots based on the correction value, wherein the test pattern includes an adjustment pattern and a reference pattern, the adjustment pattern includes multiple overlapping patterns that are each formed by overlapping two basic patterns, a shift amount of the two basic patterns in a relative movement direction of the recording medium and the recording head is different for each of the multiple overlapping patterns, the reference pattern is formed of a predetermined pattern corresponding the multiple overlapping patterns, and, in the process of correcting the recording positions of dots, the controller causes the recording head to record the corresponding overlapping patterns and predetermined pattern at positions of which the light reflection characteristics are substantially the same, obtains a correction value of the recording positions of dots based on detection results respectively obtained by detecting with the detector the multiple overlapping patterns forming the adjustment pattern and a detection result obtained by detecting with the detector the predetermined pattern forming the reference pattern, and corrects the recording positions of dots based on the correction value.

* * * * *